US006131922A

United States Patent [19]

Klukos

[11] Patent Number: 6,131,922

[45] Date of Patent: Oct. 17, 2000

[54] ROLLER SKATE BRAKE ARRANGEMENT

[76] Inventor: Edward O. Klukos, 10030 152nd Ave., West Olive, Mich. 49460

[21] Appl. No.: 09/407,696

[22] Filed: Sep. 28, 1999

Related U.S. Application Data

[60] Division of application No. 09/127,070, Jul. 30, 1998, abandoned, which is a continuation-in-part of application No. 08/740,497, Oct. 30, 1996, Pat. No. 5,791,663, which is a continuation-in-part of application No. 08/442,950, May 17, 1995, Pat. No. 5,630,597, which is a continuation-in-part of application No. 08/302,046, Sep. 7, 1994, Pat. No. 5,511,803.

[51] Int. Cl.[7] ..... A63C 17/14

[52] U.S. Cl. ..... 280/11.206; 188/5; 280/11.22

[58] Field of Search ..... 188/4 R, 4 B, 188/5, 24.19; 280/11.2, 11.27, 11.22, 11.21

[56] References Cited

U.S. PATENT DOCUMENTS

| | | | |
|---|---|---|---|
| 334,739 | 1/1886 | Blum . | |
| 926,646 | 6/1909 | Eubank, Jr. | 280/11.2 |
| 968,427 | 8/1910 | Simon . | |
| 1,542,239 | 6/1925 | Haas | 280/11.2 |
| 2,027,487 | 1/1936 | Means . | |
| 2,644,692 | 7/1953 | Kahlert . | |
| 3,013,296 | 12/1961 | Lewin | 16/254 X |
| 3,224,785 | 12/1965 | Stevenson . | |
| 4,088,334 | 5/1978 | Johnson . | |
| 4,275,895 | 6/1981 | Edwards . | |
| 4,402,520 | 9/1983 | Ziegler . | |
| 4,453,726 | 6/1984 | Ziegler . | |
| 4,704,604 | 11/1987 | Fuhs | 16/254 X |
| 5,052,701 | 10/1991 | Olson . | |
| 5,088,748 | 2/1992 | Koselka et al. . | |
| 5,135,244 | 8/1992 | Allison . | |
| 5,183,275 | 2/1993 | Hoskin . | |
| 5,192,099 | 3/1993 | Riutta . | |
| 5,232,231 | 8/1993 | Carlsmith . | |
| 5,280,931 | 1/1994 | Horton . | |
| 5,308,093 | 5/1994 | Walin . | |
| 5,388,844 | 2/1995 | Pellegrini, Jr. | 280/11.2 |
| 5,397,137 | 3/1995 | Pellegrini, Jr. et al. . | |
| 5,411,276 | 5/1995 | Moldenhauer | 280/11.2 |

(List continued on next page.)

FOREIGN PATENT DOCUMENTS

0585764B1 11/1995 European Pat. Off. .

*Primary Examiner*—Michael Mar
*Attorney, Agent, or Firm*—Price Heneveld Cooper Dewitt & Litton

[57] ABSTRACT

A roller skate includes a wheeled frame including aligned wheels, a shoe supported on the wheeled frame and including a cuff that can be flexed and moved relative to the wheeled frame, and a braking mechanism. The braking mechanism includes an extension frame movably supported on the wheeled frame, and further includes a braking member supported on the extension frame for movement between a ground-engaging position and a ground-clearing position, and still further includes a link operably connecting the extension frame to the cuff, so that a skater can flex the cuff to angularly move the extension frame to carry the braking member into contact with a ground surface. In one form, the braking mechanism includes an adjuster device for adjusting an angular position of the extension frame relative to the wheeled frame, the adjuster being configured to change a manually set normal clearance of the braking member to a ground surface, so that the braking member engages the ground surface more or less quickly due to the changes in the angular position. In another form, the braking mechanism includes a toggle linkage operably connected to the cuff link for providing mechanical advantage to pivot the extension frame when a skater desires to operate the braking mechanism and an actuator for moving the toggle linkage between the ground-engaging and ground-clearing positions. In still another aspect, a partial-turn fastener or fastenerless connector engages a configured hole to pivotally attach the extension frame to the wheeled frame, the partial-turn fastener and/or fastenerless connector being rotatable between a locked position in which the fastener cannot be removed and an unlocked position in which the fastener or fastenerless connector can be removed.

22 Claims, 24 Drawing Sheets

U.S. PATENT DOCUMENTS 5,465,984 11/1995 Pellegrini, Jr. et al. .
5,486,012 1/1996 Olivieri ..... 280/11.2
5,511,803 4/1996 Klukos .
5,630,597 5/1997 Klukos .
5,735,537 4/1998 Zorzi ..... 280/11.2
5,887,682 3/1999 Zorzi et al. ..... 188/5
5,918,888 7/1999 Pellegrini et al. ..... 280/11.2
5,934,691 8/1999 Stivali ..... 280/11.2
6,010,137 3/1999 Keleny ..... 280/11.2

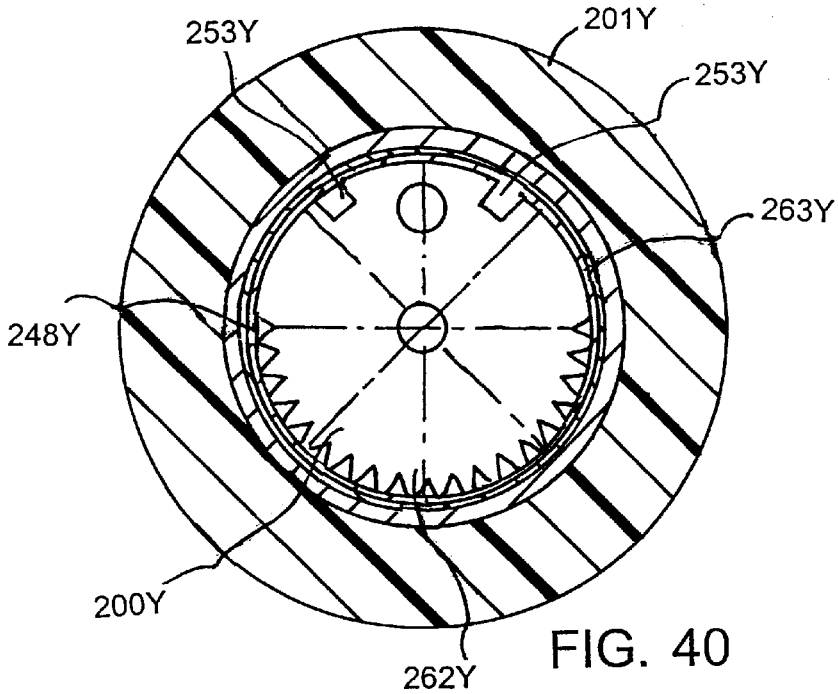
FIG. 40
FIG. 55
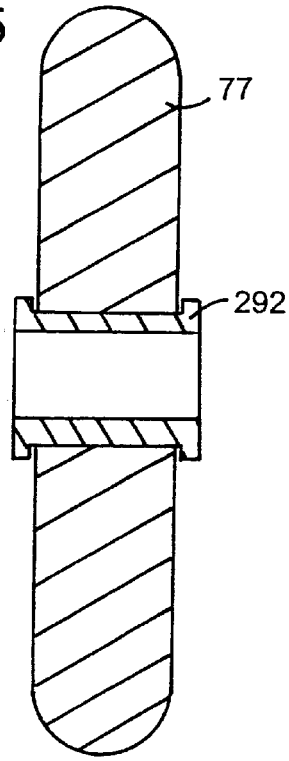

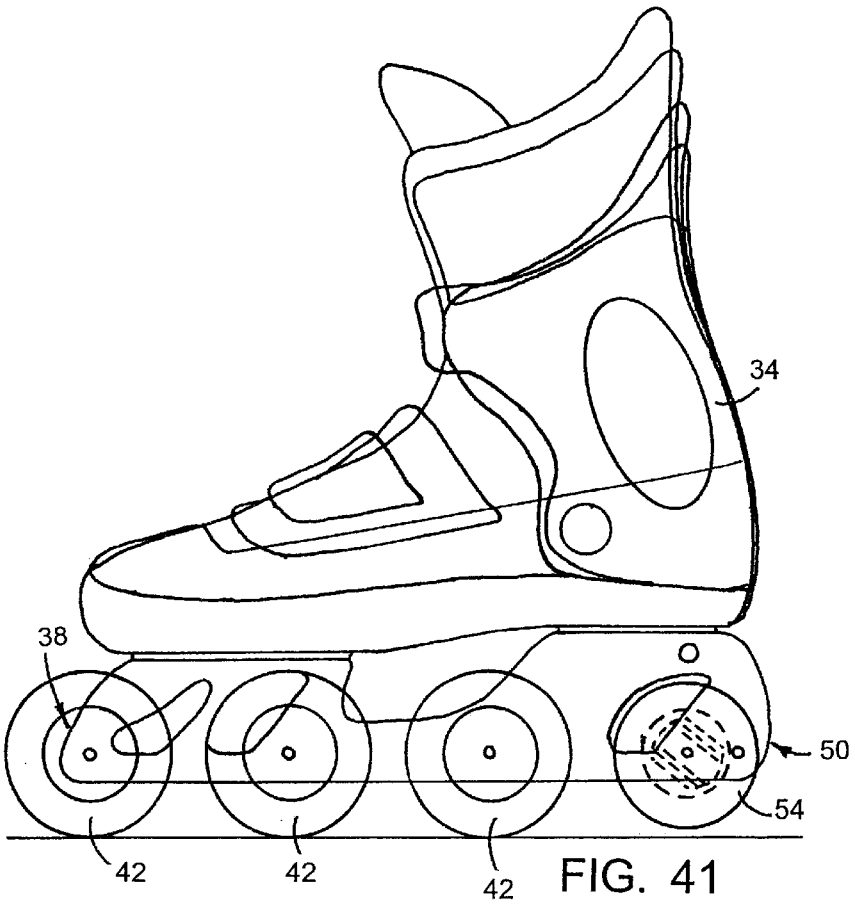
FIG. 41
FIG. 42
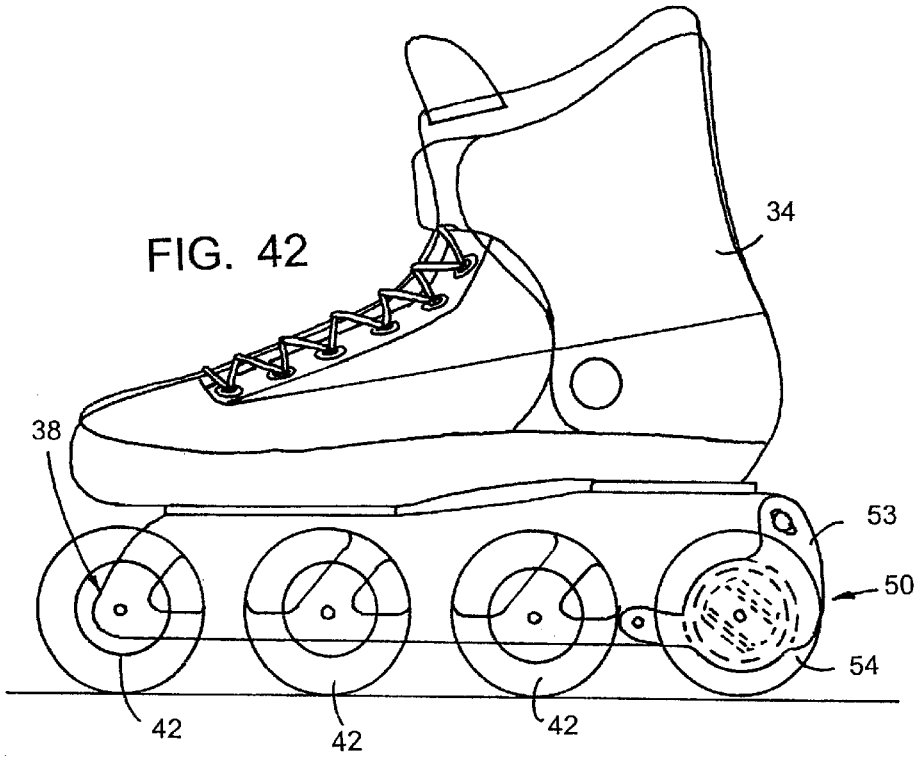

ROLLER SKATE BRAKE ARRANGEMENT

CROSS REFERENCE TO RELATED APPLICATIONS

This application is a divisional of application Ser. No. 09/127,070, filed Jul. 30, 1998, entitled ROLLER SKATE BRAKE ARRANGEMENT now abandoned, which is a continuation-in-part of application Ser. No. 08/740,497, filed Oct. 30, 1996, entitled BRAKE SYSTEM FOR ROLLER SKATES now U.S. Pat. No. 5,791,663; which is a continuation-in-part of application Ser. No. 08/442,950, filed May 17, 1995, entitled BRAKE SYSTEM FOR ROLLER SKATES, now U.S. Pat. No. 5,630,597; which is a continuation-in-part of application Ser. No. 08/302,046, filed Sep. 7, 1994, entitled BRAKE FOR ROLLER SKATES, now U.S. Pat. No. 5,511,803.

BACKGROUND OF THE INVENTION

This invention relates to brake systems, and more particularly relates to a brake for roller skates, although not limited to only roller skates.

A skater using in-line roller skates must be able to safely stop or slow down regardless of his/her expertise, and further must always be "in control," so that they do not risk running into other skaters or bystanders. Beginners, in particular, have problems as they are learning to skate due to the free running nature of roller skates. However, more experienced skaters also desire fine levels of control to facilitate quick turns and stops. A number of roller skate brakes have been constructed for these purposes. However, known roller skate brakes have several problems as noted below.

The most common braking system now used on in-line roller skates includes a wear block attached to a rear of the skate that can be dragged on a skating surface to provide a braking action. However, the wear block rapidly wears away, and thus has a limited life. Further, the wear block is subject to catching or hooking on depressions, such as on the edges of or depressions in concrete sections in a sidewalk, such that the user may trip and fall. Still further, a wear block will often pick up small stones that embed themselves in the wear block. These small stones dramatically change the coefficient of friction generated by the wear block as the wear block is dragged on the skating surface, thus causing the brake to provide an uncertain and inconsistent brake force. Still further, the tilt angle of the roller skate to engage the wear block with the ground changes as the wear block becomes worn, thus creating uncertainty as to when or how much braking force will result from an attempt to brake.

Some in-line roller skate brakes apply a braking force to one or more of the "active" weight-supporting wheels on the skate. For example, see U.S. Pat. No. 5,232,231 to Carlsmith. However, if any of these "active" weight-supporting wheels lockup or skid, a flat spot is created on the wheel. This flat spot causes the roller skate to vibrate during use, which is very annoying and also physically tiring. Further, the vibration caused by an "active" wheel having a flat spot takes away tremendously from the enjoyment of skating. Notably, the "active" wheels on the in-line roller skates periodically support less than an equal portion of a person's weight due to unevenness of the skating surface. Thus, it is relatively common for an "active" wheel that is being braked to skid and develop a flat spot.

Another problem is that brakes sometimes stick or drag, thus causing a skater to unknowingly expend extra effort when skating.

U.S. Pat. No. 5,183,275 to Hoskin discloses a roller skate brake including a brake pad and a roller for engaging the braking pad. However, the actuating mechanism in Hoskin Pat. No. 5,183,275 involves multiple links and a braking wheel that are relatively small and intricate, such that they are mechanically more delicate and expensive to manufacture and assemble than are desired, and also that are connected in a way that is potentially not as reliable and consistent in operation as is desired. Further, in Hoskin Pat. No. 5,183,275, the braking wheel, in addition to engaging the brake pad, also engages the rear in-line weight-bearing wheel on the roller skate, thus leading to the problem of flat spots previously discussed above.

U.S. Pat. No. 5,192,099 to Riutta discloses a roller skate including a brake pad and a rear skate wheel mounted on flexible side members that flex, so that the rear skate wheel can be moved into engagement with the brake pad. The brake pad is adjustable to various fixed positions along a slot to compensate for wheel and brake pad wear. However, the problem of flat spots on wheels is not addressed. Also, the flexibility of the side members brings the durability and mechanical stability of the side members into question since, if the side members are vertically flexible along a "long" side of the cross section, they would tend to permit lateral movement and wandering of the rear wheel.

U.S. Pat. No. 5,088,748 to Koselka discloses in FIG. 1 a braking system in which a braking wheel and braking member are pivotally mounted to the roller skate by a four-bar linkage. As a practical matter, the multiple joints in the linkages are difficult to manufacture so that they operate freely yet without sloppiness. Further, even if manufactured properly, the joints are likely to loosen over time. Still further, the braking member operates on the hub of the braking wheel, such that the torque arm is small and the frictional braking force must be quite large in order to generate a desired level of braking torque on the braking wheel. Also, the device lacks adjustability. The embodiments in FIGS. 4 and 5 do not have the four-bar linkage, but rather have a pair of trailing arms supporting a braking wheel. However, the braking member operates to brake the rear weight-supporting wheel on the roller skate, thus leading to the problem of flat spots discussed above.

U.S. Pat. Nos. 4,453,726 and 4,402,520 to Ziegler disclose traditional four-wheeled roller skates where the wheels are arranged in a rectangular pattern. The roller skates include a braking wheel that cams pressure elements outwardly against two axially aligned roller wheels. Notably, the camming action tends to force the wheels apart, such that the bearings on the rear skate wheels may need constant maintenance or may fail prematurely. Further, it is noted that major modifications would be required to apply the braking system in Ziegler to an in-line roller skate.

U.S. Pat. No. 4,275,895 to Edwards discloses a cuff-actuated braking system including a brake pad that engages the two rear wheels of a rectangularly arranged, four-wheel skate. (See FIG. 3.) Notably, the brake pad engages the rear wheels, and thus flat spots and wheel wear can be a problem. Also, major modifications would be required to apply the braking system in Edwards to an in-line roller skate.

U.S. Pat. No. 2,027,487 to Means discloses a brake pad attached to a flexible support that can be flexed to engage the brake pad with the rear roller skate. In addition to the problems previously discussed relating to rear wheel flat spots and wear, major modification is required to use the device on in-line roller skates.

Aside from the above, the known roller skate brakes do not provide a natural and smooth "feel" to the skater when braking. I have not determined exactly why this is true, but I believe it to be due in part inherent characteristics in many of the prior art brakes, and the inability of the known constructions to provide a consistent and predictable braking force that increases in a manner directly correlated to the amount of force transmitted from the skate-supporting surface to the brake. Also, it is noted that many of the prior art brakes are expensive to manufacture, are expensive to maintain, and also are difficult to adjust and/or keep in adjustment.

As noted above, most roller skates are braked by biasing a wear-resistant slide block against a floor surface, with the amount of braking force depending on the friction generated by the slide block as it is dragged across the floor surface. A problem with the slide block is that the braking force is inconsistent, and further the brake does not hit the ground at the same time as the slide block wears down. With a rolling brake wheel of the present invention, the wheel maintains continuous contact with the floor surface and does not slide, nor does the present brake wheel wear away as fast as a slide block. Instead, the amount of friction for braking comes from the amount of force generated to bias a brake shoe or other braking component against the rotating brake wheel or its hub. The frictional force for breaking loose the braking wheel from the floor surface is normally never exceeded. This is intentionally done so that the braking wheel does not slide and in turn does not develop flat spots, and further so that the braking wheel does not wear out as quickly.

However, even though it is important not to brake a braking wheel so hard as to cause it to slide, my testing has also shown that it is sometimes desirable to amplify the amount of force generated against a braking wheel as a skater leans rearwardly as one way of adding control to the person skating. For example, by biasing the brake shoe with mechanical advantage, a skater can control the braking force with greater finesse and with less "brute force." More specifically, my testing has shown that, with sufficient mechanical advantage, a rear end of the person's skate can be lifted off of the floor surface with the entire person's weight supported only by the front wheel of the skate and the rear braking wheel. This position provides the maximum amount of force that a skater can apply to a skate brake while still maintaining wheel contact with the ground. A non-linear braking force is also sometimes desirable where a continuously linearly increasing force applied by a skater results in an exponentially increasing braking force.

Another problem in the prior art is attachment of brake components to the skate's wheeled frame. Separate fasteners that require tools for removal can be frustrating to remove because proper tools are not available or the skater is not good at using the tools. Further, the separate fasteners can be lost.

Thus, braking systems for in-line roller skates and other wheel constructions solving the aforementioned problems are desired.

SUMMARY OF THE INVENTION

One aspect of the present invention, a roller skate includes a wheeled frame having a rear end with a first connector thereon, and a braking mechanism including an extension frame supported on the wheeled frame. The extension frame includes a second connector configured to releasably engage the first connector when angularly oriented in an installation position and configured to securely non-releasably engage the first connector when rotated to a use position where the second connector is securely retained by the first connector.

In another aspect of the present invention, a roller skate includes a wheeled fame having aligned wheels, a shoe supported on the wheeled frame, and a braking mechanism including an extension frame movably supported on the wheeled fame. A braking member is supported on the extension frame for movement between a ground-clearing position where the extension frame is positioned for skating and a ground-engaging position where the extension frame is rotated rearwardly for braking. The roller skate still further includes an adjuster device including teeth configured to adjustably engage a mating area on the wheeled frame, with the adjuster device being configured to adjustably set an initial clearance of the braking member to a ground surface when in the ground clearing position. This causes the braking members to engage the ground surface more or less quickly when the extension frame is rotated rearwardly based on changes in the initial angular position.

These and other advantages and features of the present invention will be further understood by a person of ordinary skill in the art by a review of the attached specification, claims, and appended drawings.

BRIEF DESCRIPTION OF THE DRAWINGS

FIG. 40 is a side view of another internal braking system embodying the present invention;

FIG. 41 is a side view of an in-line skate with a braking system embodying the present invention;

FIG. 42 is a side view of an in-line skate with a braking system embodying the present invention;

FIG. 55 is a cross-sectional view of a snap-attach skate tire on a particularly configured mating hub;

DETAILED DESCRIPTION OF PREFERRED EMBODIMENTS

Figures 1, 5, 6, 18:
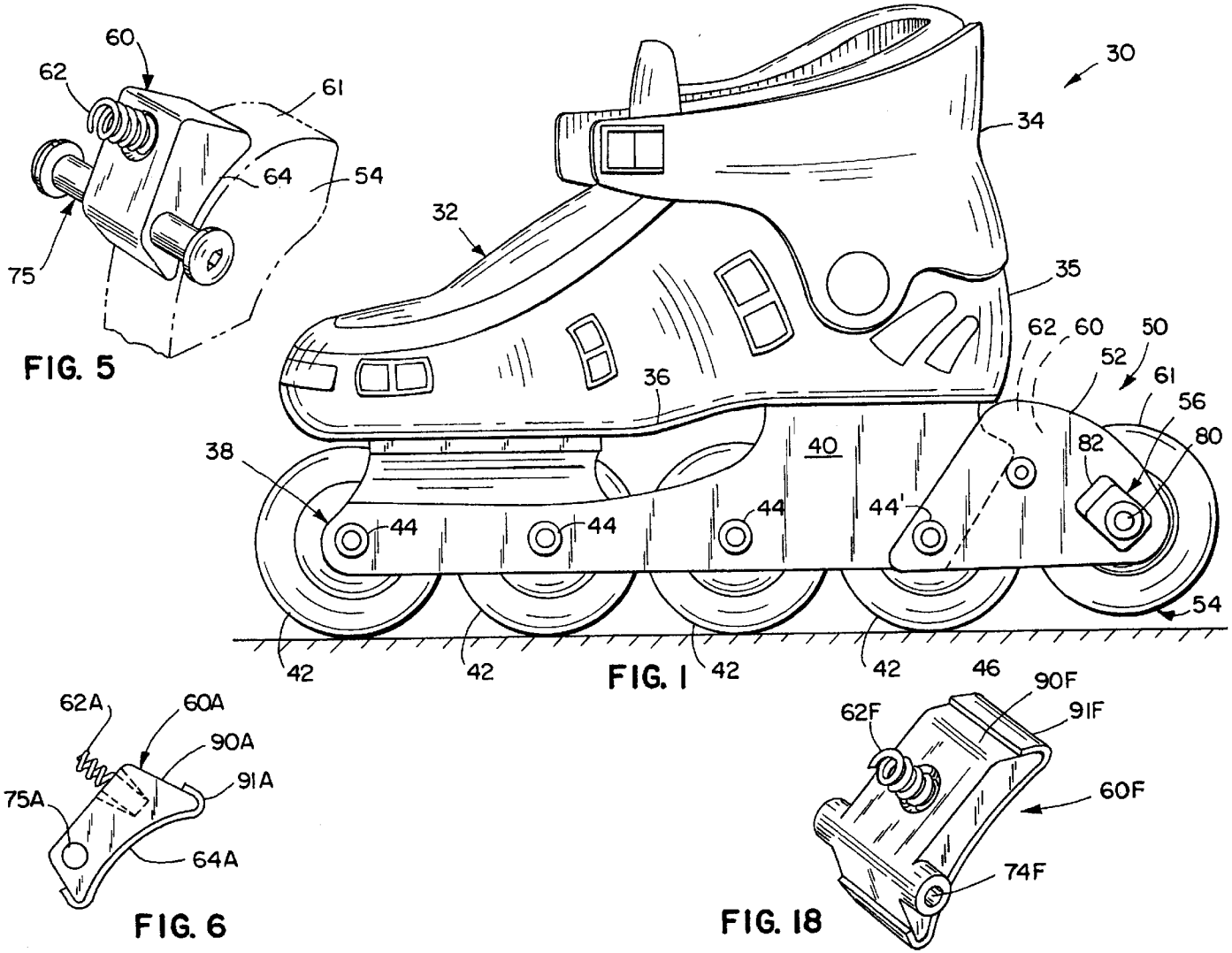
FIG. 1 is a side view of an in-line skate embodying the present invention.
FIG. 5 is a perspective view of the brake pad and pivot pin supporting the brake pad, the braking wheel being shown in phantom and the extension having been removed to better show the arrangement of the brake pad and braking wheel.
FIG. 6 is a side view of a modified brake pad.
FIG. 18 is a perspective view of the braking pad shown in FIG. 16.

An in-line roller skate 30 (FIG. 1) embodying the present invention includes a shoe 32 having a cuff or ankle support 34, a boot 35, and a sole 36. A wheel-supporting frame 38 is attached to the bottom of sole 36. Wheel-supporting frame 38 includes a pair of spaced apart flanges 40 that extend downwardly, and four aligned "active" weight-supporting wheels 42 and 42" (wheel 42' being the rear wheel) are operably secured between flanges 40 on axles 44 by roller bearings (not specifically shown). Wheels 42 and 42' define a vertical plane and the bottommost points on wheels 42 and 42' are co-linear, so that they simultaneously engage a skate-supporting surface 46, such as cement or pavement covered sidewalk or parking lot. The present invention is focused on the braking system 50 attached to the rear of frame 38.

Braking system 50 (FIG. 1) includes a U-shaped extension 52 fixedly connected to the rear of frame 38. Extension 52 includes slots 82 and 85 for slidably receiving a support mechanism 56. An axle 80 operably rotatably supports a braking wheel 54 on support mechanism 56. A brake pad 60 is adjustably secured to extension 52 proximate the outer upper surface 61 of braking wheel 54, and a spring 62 biases the brake pad 60 against braking wheel 54. As a skater initially pivots skate 30 rearwardly about the rear wheel 42', braking wheel 54 rollingly engages hard surface 46 and rubs against braking surface 64 of braking pad 60 to create an initial predetermined level of braking force. Since the skate-supporting surface 46 is rougher than the brake pad 60, the braking wheel 54 rolls on surface 46 rather then slides or skids. As the skater further pivots rearwardly, skate-supporting surface 46 presses against braking wheel 54 with increased pressure causing slide mechanism 56 to move braking wheel 54 toward brake pad 60, thus increasing the frictional braking force on braking wheel 54.

By adjusting the tension on spring 62, such as by placing spacers under the spring or by replacing spring 62 with a stronger or weaker spring, the frictional force/displacement curve of brake pad 60 on braking wheel 54 can be selectively preset, both when the spring 62 is fully extended and when spring 62 is partially compressed by movement of braking wheel 54. Thus, the initial braking force and also the load/deflection curve of the brake pad and braking wheel can be controlled for optimal function and performance. Notably, support mechanism 56 can be designed to limit the movement of braking wheel 54 toward brake pad 60 to prevent lockup of braking wheel 54 if desired, such as by designing support mechanism 58 to engage the end of slot 82 before braking wheel 54 engages brake pad 60 with a lockup force. It is noted that the angle of slot 82 is important since this determines the resultant force along slot 82 caused by forces transmitted from ground 46 through wheel 54 to extension 52. An angle of about 45° has been found to be preferable. Angles that are closer to vertical than 45° tend to cause wheel 54 to lockup, and angles that are closer to horizontal than 45° tend to provide too low of braking forces. At 45°, a desired balance is achieved between the torque generated by the ground on the braking wheel and the braking torque generated by brake pad 60. It is noted that many variables offset the braking force and/or the tendency to lockup the braking wheel, such as the materials chosen, torque arms, coefficients of friction, and the like.

Figure 3:
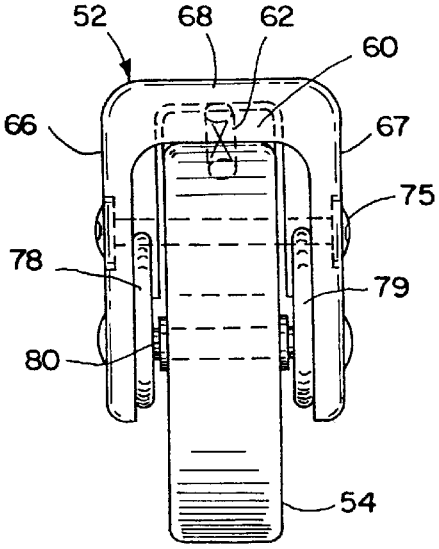
FIG. 3 is a rear end view of the braking system shown in FIG. 2.
Figure 4:
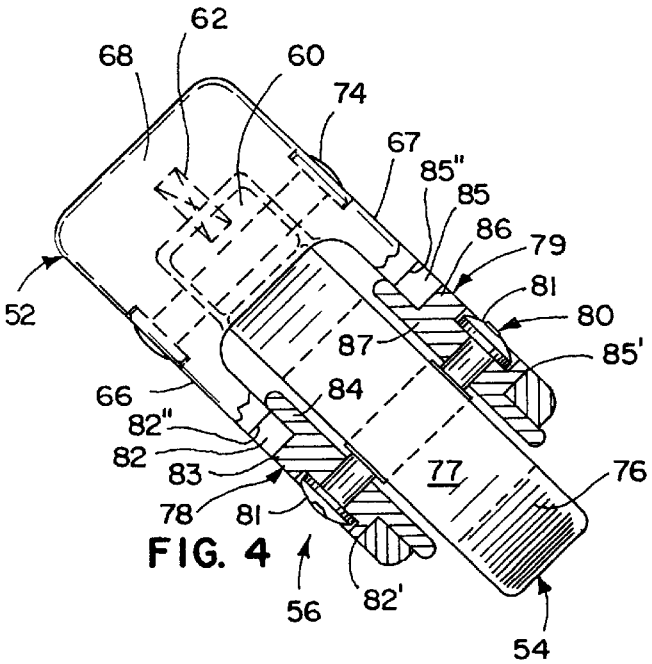
FIG. 4 is a cross-sectional view taken along the lines IV—IV in FIG. 2.
Figure 7:
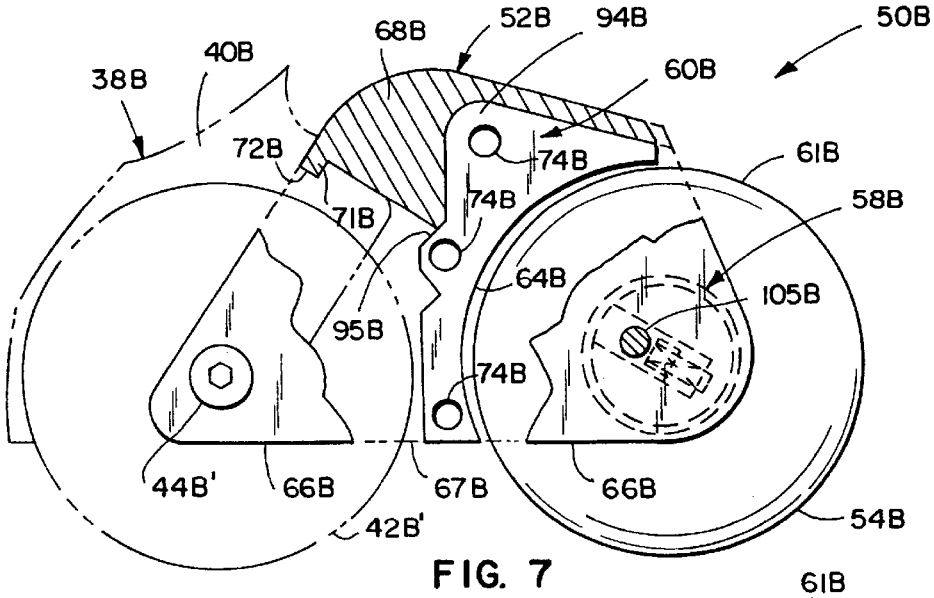
FIG. 7 is an enlarged, fragmentary side view partially in cross section of a modified braking system embodying the present invention.
Figure 8:
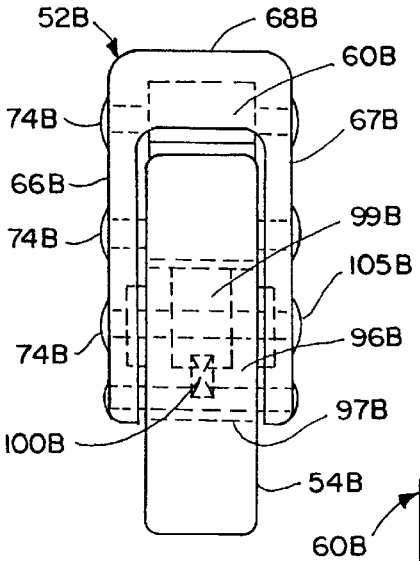
FIG. 8 is a rear view of the braking system shown in FIG. 7.
Figure 9:
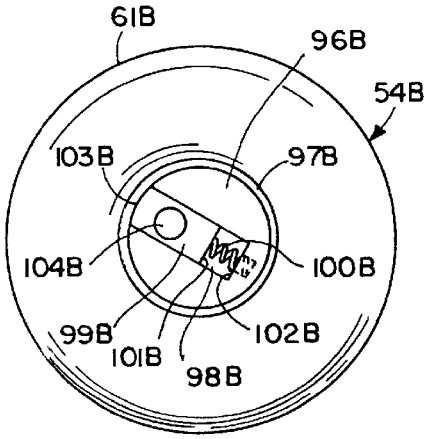
FIG. 9 is a side view of the wheel including the slotted hub and the slide members shown in FIG. 7.
Figure 10:
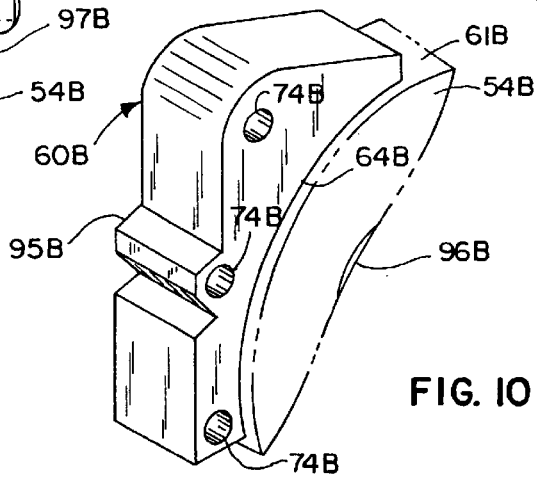
FIG. 10 is a perspective view of the braking pad shown in FIG. 7, the braking wheel being shown in phantom and the extension having been removed to reveal the arrangement of the braking pad and braking wheel.
Figure 11:
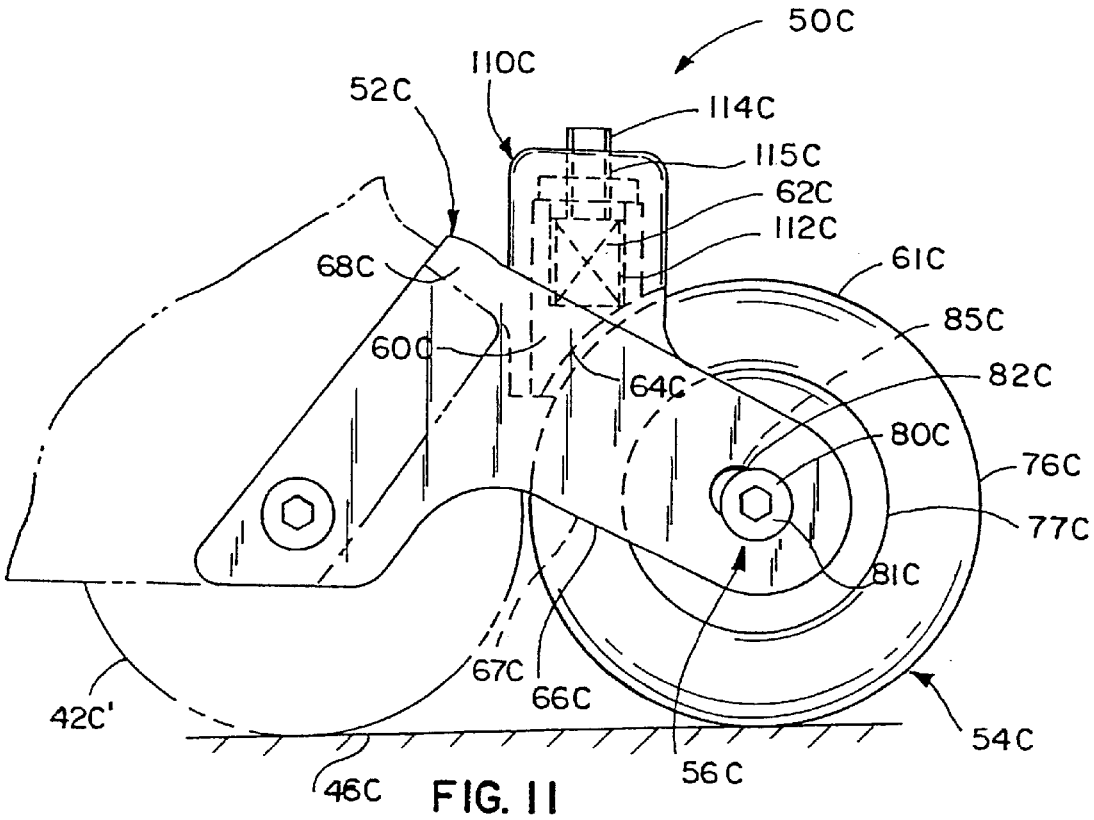
FIG. 11 is an enlarged, fragmentary side view of another braking system embodying the present invention.
Figure 12:
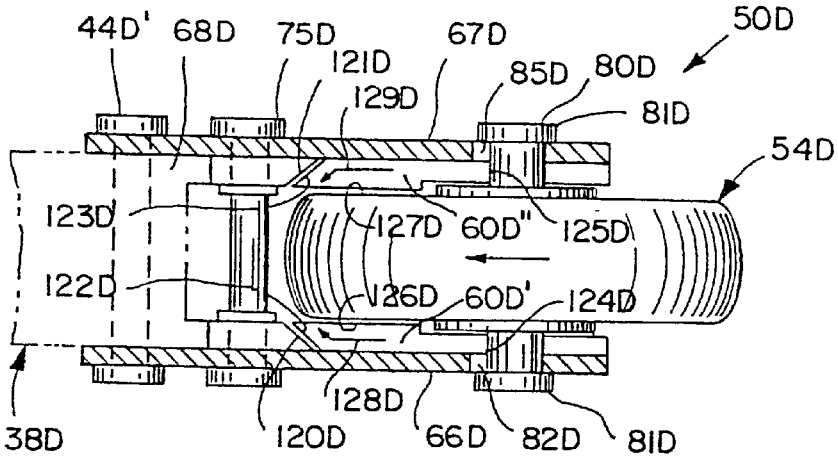
FIG. 12 is an enlarged, fragmentary top view of yet another braking system embodying the present invention.
Figure 13:
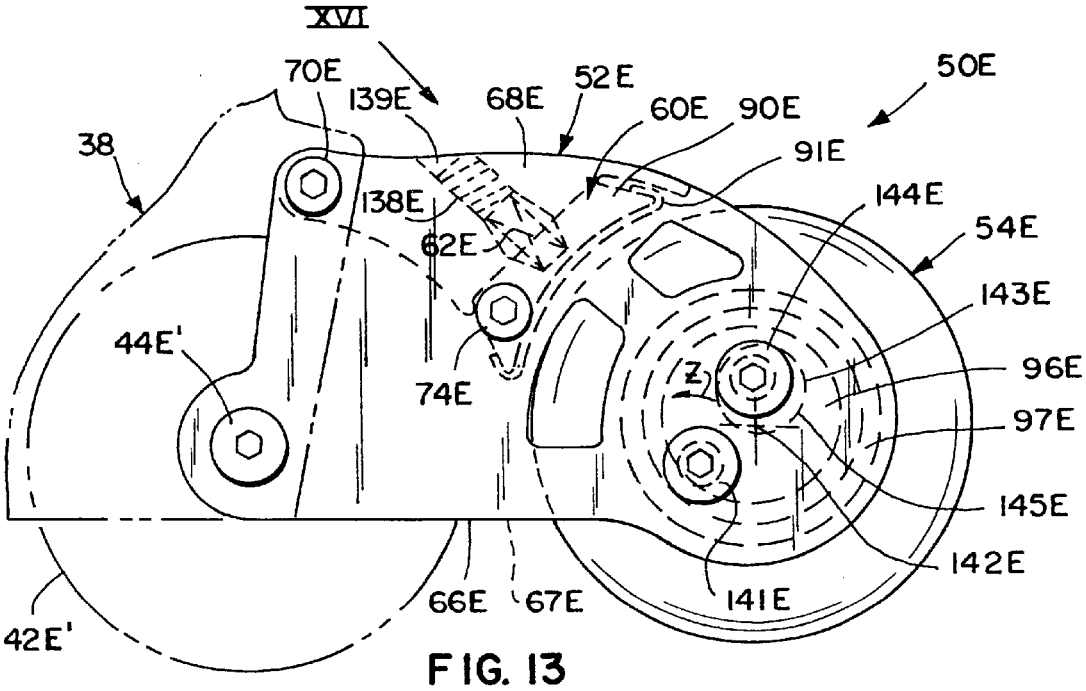
FIG. 13 is an enlarged fragmentary side view of yet another braking system embodying the present invention.
Figure 15:
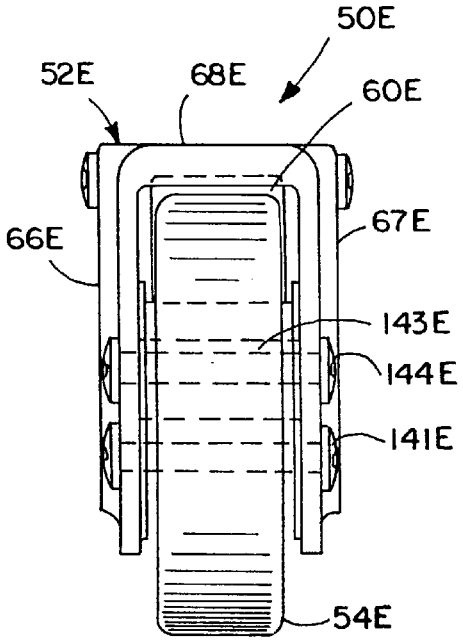
FIG. 15 is a rear view of the braking system shown in FIG. 13.
Figure 14:
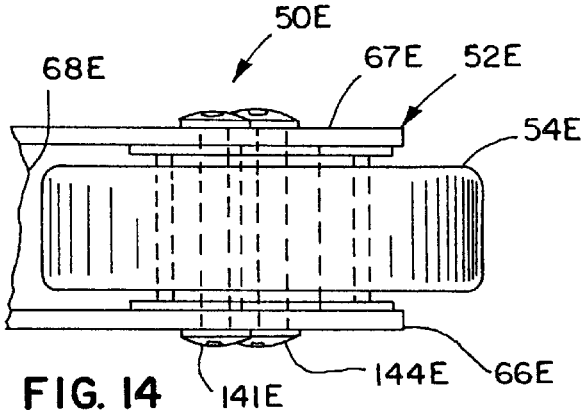
FIG. 14 is a fragmentary top view of the braking system shown in FIG. 13.
Figure 16:
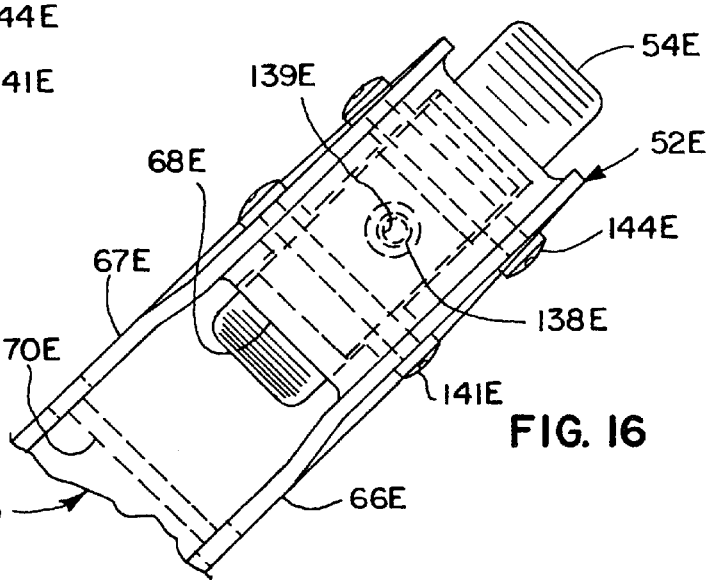
FIG. 16 is a top view taken in the direction of arrow 16 in FIG. 13.

Extension 52 (FIGS. 2–4) is U-shaped and includes opposing side flanges 66 and 67 interconnected by an intermediate transverse section 68. The extension flanges 66 and 67 are spaced apart to mateably engage the outside surfaces of wheel frame flanges 40, and transverse section 68 is configured to mateably engage a tail section 69 on wheel frame flanges 40. The rivet-like axle 44' extends through holes in flanges 66 and 67 and through corresponding holes in wheel frame flanges 40. Also, a tab 71 on transverse section 68 engages a mating notch 72 on tail section 69. Axle 44' and tab 71 fixedly retain extension 52 on wheel-supporting frame 38. Notably, retainer arrangements other than tab 71 and notch 72 can also be used, such as a link connected to the frame 38 or to the cuff support 34, or another fastener.

Brake pad 60 is positioned in the pocket between flanges 66 and 67 under transverse section 68. A rivet-like fastener 74 extends through flanges 66 and 67 and through a hole 75 in brake pad 60 to pivotally support brake pad 60 on extension 52. Transverse section 68 and brake pad 60 define opposing depressions that are generally aligned for receiving coil spring 62. Coil spring 62 is compressed in these depressions and accordingly biases brake pad 60 rotatingly about rivet-like fastener 74 toward braking wheel 54. Brake pad 60 includes an arcuately-shaped surface 64 for engaging the outer surface 61 of braking wheel 54. By engaging outer surface 61 of braking wheel 54, the friction of brake pad 60 on braking wheel 54 operates over a maximum torque arm for maximum braking force on braking wheel 54 while not unnecessarily wearing braking wheel 54. Notably, the leading edge of brake pad 60 acts as a wiper to keep braking wheel 54 clean, as well as to keep dirt from getting onto braking surface 64. Also, this leading edge provides an initial braking force due to the bias of spring 62.

Braking wheel 54 includes a tire portion 76 and a hub portion 77 fixedly secured to tire portion 76. Support member 56 includes a pair of opposing slide members 78 and 79 (FIG. 6) positioned on opposing sides of hub portion 77 that are retained thereto by the axle 80. Axle 80 includes opposing sections that mateably threadably engage and that include capped ends 81 to retain axle 80 in place once installed in slide members 78 and 79 and braking wheel 54. Roller bearings (not specifically shown) support hub portion 77 on axle 80. Alternatively, a solid lubricated bearing can be used in place of roller bearings. Extension flange 66 includes a slot 82 that extends toward brake pad 60. Slide member 78 includes a rectangular section 83 for slidably engaging slot 82, and a planar section 84 for slidably engaging the inside surface of extension flange 66. Similarly, extension flange 67 includes a slot 85 that extends toward brake pad 60. Also, slide member 79 includes a rectangular section 86 for slidably engaging slot 85 in extension flange 67, and a planar section 87 for slidably engaging the inside surface of extension flange 67. Thus, slide members 78 and 79, braking wheel 54, and axle 80 are adapted to slide as a unit along slots 82 and 85 toward (and away from) brake pad 60. However, spring 62 biases brake pad 60 against braking wheel 54 causing braking wheel 54 to move to the brake-pad remote ends 82' and 85' of slots 82 and 85.

Figure 2:
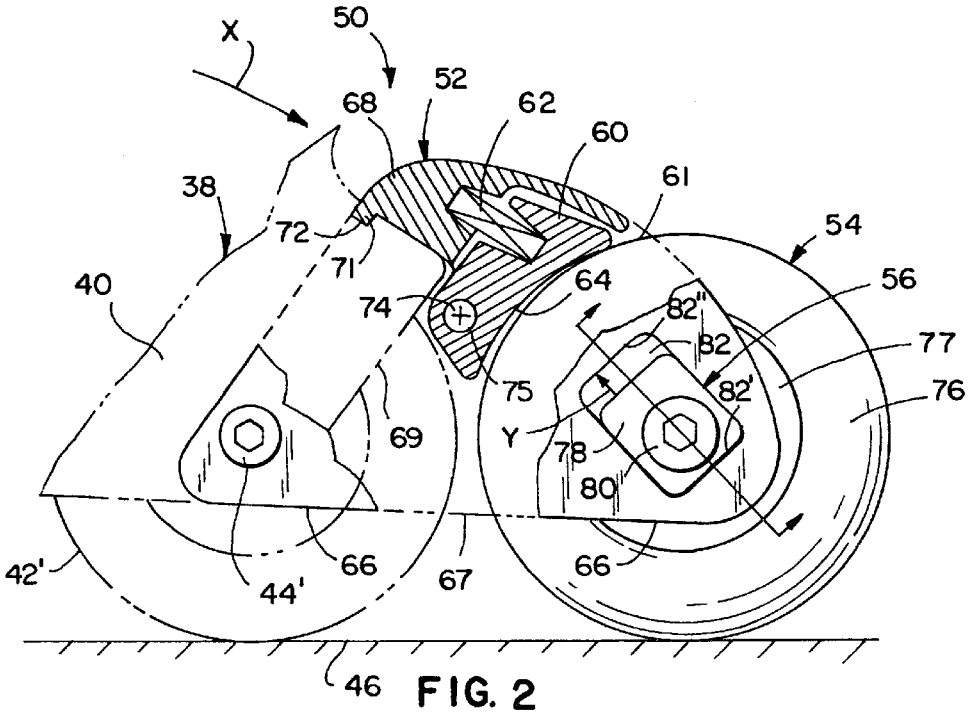
FIG. 2 is an enlarged, fragmentary side view partially in cross section of the braking system shown in FIG. 1.

To apply a braking force to in-line roller skate 30, a skater pivots rearwardly in direction "X" about the rear weight-bearing wheel 42" until braking wheel 54 engages skate-supporting surface 46 and begins to roll (FIG. 2). (Compare the relationship of braking wheel 54 and surface 46 in FIGS. 1 and 2.) The brake pad 60 (FIG. 2) frictionally drags on braking wheel 54 due to the bias of spring 62 which causes brake pad 60 to rotate about rivet-like fastener 74 into engagement with braking wheel 54. Thus, an initial braking force is created to gradually slow down the speed of the skater. Notably, braking wheel 54 is interchangeable with wheels 42, thus reducing the need for an excessive number of special repair or replacement parts for braking system 50.

As the skater continues to pivot rearwardly an additional angular amount, skating surface 46 presses against braking wheel 54 with sufficient force to cause slide members 78 and 79 to slide along slots 82 and 85, respectively, in direction "Y." This carries braking wheel 54 into increasing frictional engagement with brake pad 60. In turn, spring 62 is compressed by the force on brake pad 60. Thus, the braking force is only gradually increased since brake pad 60, to a certain extent but with increasing resistance, moves with braking wheel 54.

Once slide members 78 and 79 reach the ends 82' and 85' of slots 82 and 85, braking wheel 54 cannot move any farther toward brake pad 60. Thus, the surfaces at the ends of slots 82 and 85 act as stops to limit the movement of braking wheel 54, and thus limit the maximum braking force that braking system 50 can generate. Alternatively, slots 82 and 85 can be designed, so that the ends 82" and 85" are never reached by slide members 78 and 79. Notably, by changing the length and spring constant of spring 62, substantially any initial braking force and substantially any load/deflection curve can be obtained by braking system 50. Notably, the movement of braking wheel 54 directly into brake pad 60, and the overall arrangement of braking system 30, provides the skater with an excellent "feel" for the braking force, thus giving the skater excellent control. The arrangement allows axle 80 to "float" in direct response to the skater's movement, thus giving the skater a direct feel for the braking action. The arrangement, and in particular the orientation of slots 82 and 85, provides a mechanical advantage so that the frictional force between the braking wheel 54 and the hard surface 46 is always greater than the force between the brake pad 60 and the braking wheel 54. Thus, there is very little likelihood that braking wheel 54 will lockup and skid, even if the brakes are applied very hard.

Several additional embodiments of roller skates, braking systems, and components thereof are shown in FIGS. 6–55. In these embodiments, to reduce redundant discussion, identical or comparable components and features are identified by use of identical numbers as used in describing roller skate 30, but with the addition of the letters "A," "B," "C" and etc.

A modified brake 60A (FIG. 6) includes a backing member or body 90A and a liner 91A. Body 90A is made from a durable structural material, such as a polymer, and brake liner 91A is made from a durable wear-resistant material, such as metal. The ends of liner 91A wrap around and snap lock onto body 90A. Alternatively, liner 91A can be insert molded into body 90A. Body 90A includes a hole 75A for receiving pivot pin 74A, and a depression for receiving an end section of spring 62A.

A modified braking system 50B (FIGS. 7–10) includes an extension 52B having opposing side flanges 66B and 67B interconnected by an intermediate section 68B. Brake pad 60B is fixedly secured to extension 52B by three rivet-like fasteners 74B. Brake pad 60B includes an arcuate surface 64B that extends about 90° around braking wheel outer surface 61B. The upper end 94B of brake pad 60B and a notch 95B on the back of brake pad 60B engage mating surfaces on intermediate flange 68B of extension 52B to fixedly support brake pad 60B.

Support mechanism 56B includes a hub 96B rotatably positioned in a centered hole in raking wheel 54B by roller bearings (not specifically shown, but located at raceway 97B). Hub 96B includes a rectangularly-shaped, radially extending slot 98B. A slide member 99B is slidably positioned in slot 98B, and hub 96B is biased in a direction parallel slot 98B by a spring 100B that is compressed between the inner end 101B of slide member 99B and the surface 102B of hub 96B forming the end of slot 98B. The outer end 103B of slide member 99B forms a section of the raceway for the roller bearings in raceway 97B, if roller bearings are used. Slide member 99B is secured at a desired angle between the inside surfaces of extension side members 66B and 67B at a predetermined angle for optional transfer of forces from ground through braking wheel 54B. This angle has been determined to be about 45° from horizontal for optimal results. Angles that are more vertical tend to allow the braking wheel 54B to lockup, while angles that are more horizontal tend to not provide enough braking force. A hole 104B extends through slide member 99B for receiving axle-like fastener 105B. Hub 96B is movable relative to extension side members 66B and 67B and slide member 99B.

Braking system 50B provides a longer wearing brake system than braking system 30 since a larger braking area is provided on surface 64B for engaging wheel outer surface 61B than on surface 64. Also, brake pad 60B is not movable, and thus less movement of braking wheel 54B is required than with wheel 54. Of course, the load/deflection curve of braking system 50B is dependent upon the spring constant of spring 100B and also on the frictional characteristics of materials used to manufacture brake pad 60B and braking wheel 54B. To operate braking system 50B, the skater pivots rearwardly on rear weight-supporting wheel 42B' causing braking wheel 54B and hub 96B to slide on slide member 99B toward brake pad 60B, such that braking wheel 54B engages brake pad 60B.

Braking system 50C (FIG. 11) includes an extension 52C having slots 82C and 85C in extension flanges 66C and 67C. An axle 80C extends through and rotatably engages hub 77C to support braking wheel 54C. Axle 80C further extends through slots 82C and 85C, thus forming slide mechanism 56C. Capped ends 81C on axle 56C retain axle 56C in extension 52C. Axle 80C is slidable in slots 82C and 85C, and thus braking wheel 54C moves along slots 82C and 85C as roller skate 30C is pivoted rearwardly about rear wheel 42' and skate-supporting surface 46C presses on braking wheel 54C.

A stanchion 110C extends above intermediate section 68C. Stanchion 110C defines a generally vertically oriented pocket for slidably receiving a brake pad 60C. Brake pad 60C includes an arcuate surface 64C for engaging the outer surface 61C of braking wheel 54C. A spring 62C is positioned in a depression 112C in the top 113C of brake pad 60C. An adjustment screw 114C extends through a threaded hole 115C in the top of stanchion 110C. By adjusting screw 114C, the compression of spring 62C can be adjusted, and thus the braking force (i.e., the preload and also the load/deflection curve) can be adjusted. Notably, brake pad 60C is oriented generally tangentially to the outer surface 61C of braking wheel 54C in the direction of rotation of braking wheel 54C when it rollingly engages surface 46C. Due to the orientation of braking pad 60C, the frictional braking force between brake pad 60C and braking wheel 54C tends to draw brake pad 60C into increasing engagement, and thus the braking force is "artificially" amplified.

In the braking system 50D (FIG. 12), intermediate section 68D of extension 52D includes opposing ramps 120D and 121D adjacent the insides of opposing flanges 66D and 67D, respectively. An axle 80D rotatably supports braking wheel 54D, and further slidably engages slots 82D and 85D in extension flanges 66D and 67D. Capped ends 81D retain axle 80D in extension 52D. In braking system 50D, a pair of opposing brake pads 60D' and 60D" are located between the sides of braking wheel 54D and extension flanges 66D and 67D, respectively. Ramps 122D and 123D are located on brake pads 60D' and 60D" proximate section ramps 120D and 121D. Axle 80D extends through holes 124D and 125D on brake pads 60D' and 60D", respectively. As roller skate 30D is pivoted rearwardly, braking wheel 54D rollingly engages skate-supporting surface 46D and is moved toward roller skate 30D. This causes axle 80D to slide along slots 82D and 85D. Axle 80D engages opposing brake pad 60D' and 60D", and also causes them to slide along the inside of extension flanges 66D and 67D. As brake pad ramps 122D and 123D engage extension ramps 120D and 121D, brake pads 60D' and 60D" move at an angle along paths 128D and 129D, and bind against the sides 126D and 127D of braking wheel 54D.

An advantage of braking system 50D is that brake pads 60D' and 60D" do not brake against the outer surface 61D of braking wheel 54D, but rather brake against wheel sides 126D and 127D which are relatively clean. Further, the outside surface 61D of braking wheel 54D does not change even if sides 126D and 127D wear. Another advantage is that a braking wheel 54D can be used that is interchangeable with the other wheels (e.g., wheels 42) on the roller skate 30D. Notably, a fastener 75D extends through extension flanges 66D and 67D proximate extension ramps 120D and 121D at the points of highest stress. Thus, the strength of the design is not mechanically degraded by cyclical loading over time. Notably, the angle of ramps 120D–123D can be varied to achieve a particular load/deflection curve for the braking system 50D.

Braking system 50E (FIGS. 13–16) includes an extension 52E secured to wheel-supporting frame 38 by rear wheel axle 44E' and by rivet-like fastener 74E. Brake pad 60E is secured under intermediate section 68E by a rivet-like fastener 74E, which pivotally retains brake pad 60E to extension 52E. A spring 62E seated in a depression in intermediate section 68E and biases brake pad 60E about fastener 74E into engagement with braking wheel 54E. Brake pad 60E includes a body 90E and a brake liner 91E, not unlike brake pad 60B (FIG. 6). An adjustment screw 138E engages spring 62E for adjusting the tension on brake pad 60E. Also, threaded passageway 139E provides a passageway for removal of spring 62E, such as for replacing spring 62E. Apertures 140E in extension flanges 66E and 67E allow movement of air around brake pad 60E to cool brake pad 60E. Also, apertures 140E reduce the weight of the overall system and also provide aesthetics.

A hub 96E (FIG. 13) is rotatably supported in braking wheel 54E by roller bearings or a solid bearing located along raceway 97E. An axle-like fastener 141E extends through hub 96E and rotatably supports hub 96E at a location spaced from the axis of rotation 142E for braking wheel 54E. Fastener 141E securely engages extension flanges 66E and 67E. An oversized aperture 143E is located in hub 96E offset from axis 142E and fastener 141E. A second fastener 144E extends through aperture 143E and is securely attached to extension flanges 66E and 67E. As braking wheel 54E engages skate-supporting surface 46E, braking wheel 54E is biased toward brake pad 60E. This causes hub 96E to pivot in direction "Z," which causes braking wheel 54E to move toward brake pad 60E. The rotation of hub 96E is limited (i.e., stopped) by the engagement of second fastener 144E with the side 145E of aperture 143E. Hub 96E and the related components 141E, 143E and 144E form slide mechanism 56E. The translating sliding motion of the mechanism is an arcuate motion as shown by arrow "Z," as opposed to a linear motion of the slide mechanisms shown in FIGS. 1–12.

Braking system 50F (FIGS. 17 and 18) includes an extension 52F pivotally connected to wheel-supporting frame 38F at the rear axle 44F' of rear skate wheel 42F'. The brake pad 60F and braking wheel 54F are substantially identical to brake pad 60E and braking wheel 54E in FIGS. 13–16. However, a cuff-actuated link 148F is pivotally connected at one end to extension 52F at protrusion 149F and is pivotally connected at its other end to cuff support 34F at protrusion 150F. In addition to the movement of braking wheel 54F toward braking pad 60F, cuff-actuated link 148F causes extension 52F and brake pad 60 to pivot about rear axle 44F' toward braking wheel 54F when the skater leans rearwardly on in-line skate 30F. Also, the forces generated on the ankle of the skater by lint 148F gives the skater an excellent "feel" or sensitivity to the braking force being generated.

Figure 17:
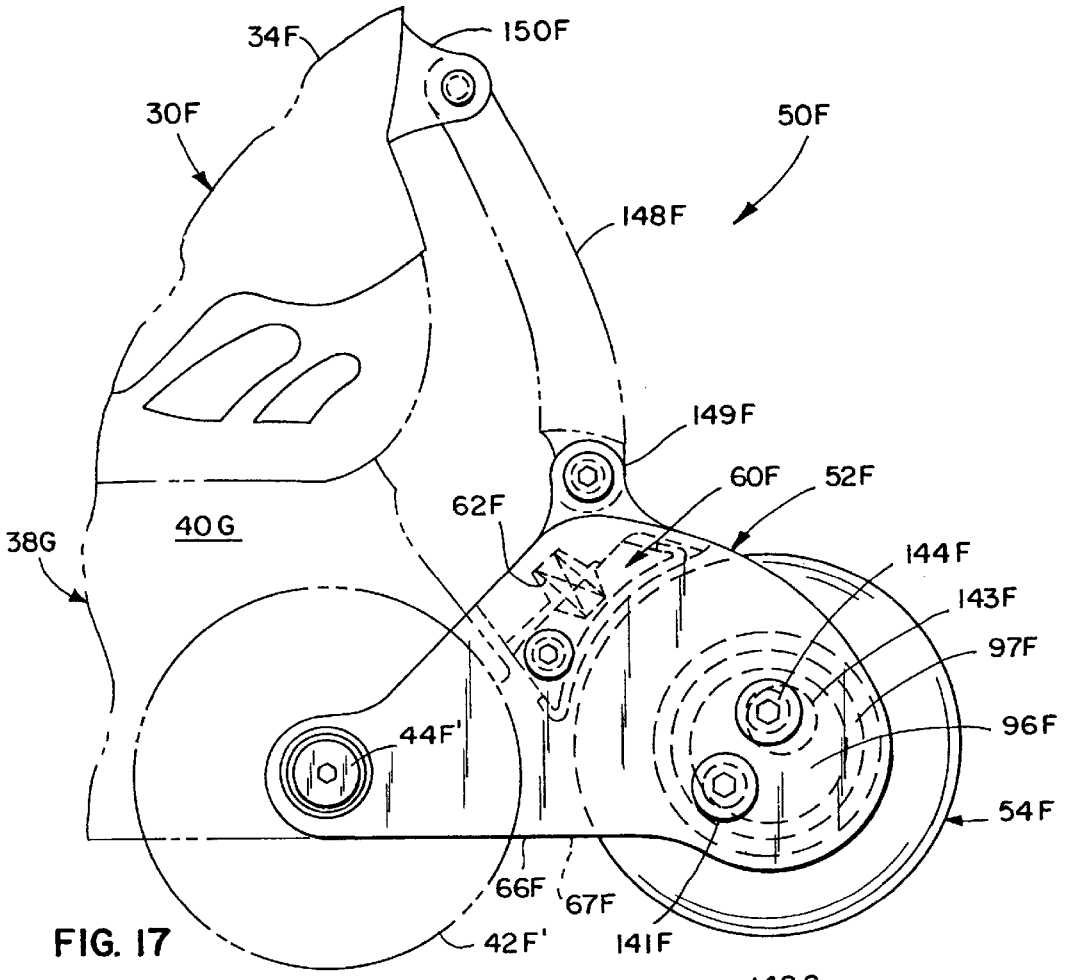
FIG. 17 is an enlarged, fragmentary side view of yet another braking system embodying the present invention.
Figure 19:
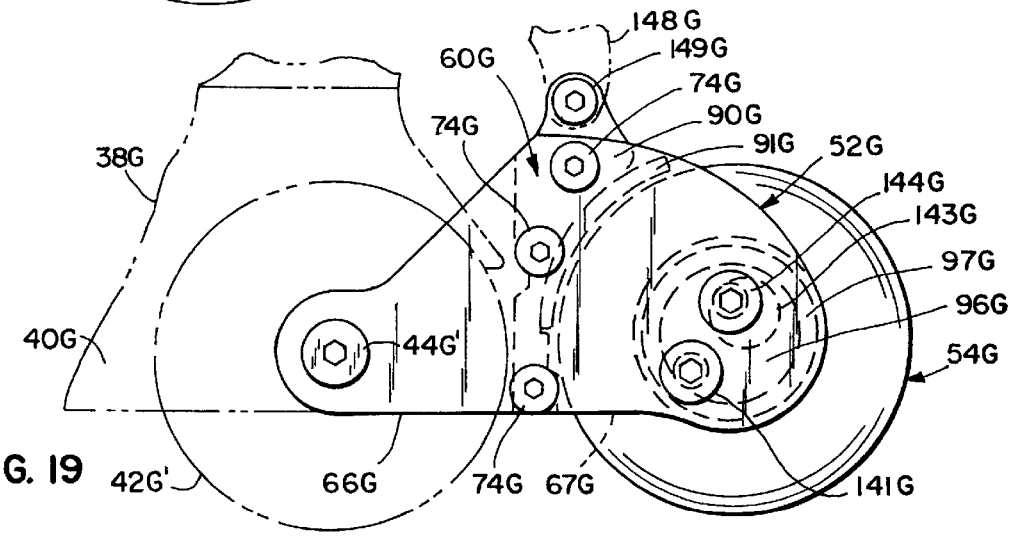
FIG. 19 is an enlarged, fragmentary side view of yet another braking system embodying the present invention.
Figure 20:
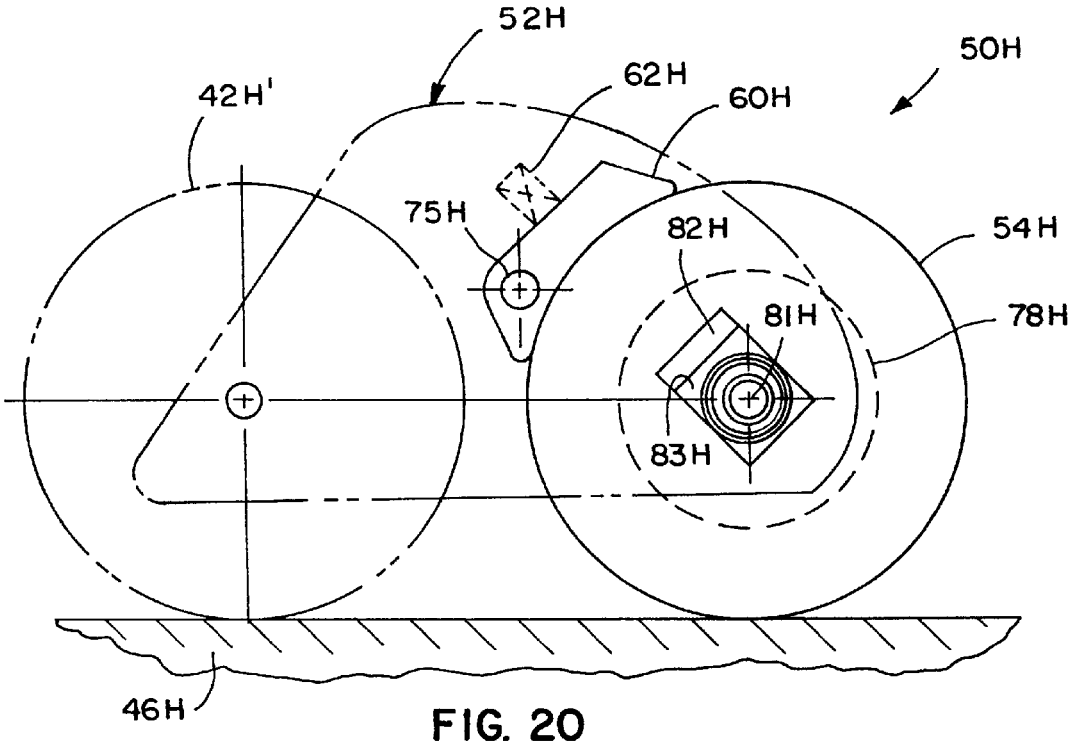
FIG. 20 is a fragmentary side view of another braking system embodying the present invention.

Braking system 50G (FIG. 19) includes an extension 52G pivotally connected to wheel-supporting frame 38G that is comparable to extension 52F in FIG. 17. Also, cuff-actuated link 148G and braking wheel 54G including hub 96G (FIG. 19) are comparable to link 148F and braking wheel 54F including hub 96F (FIG. 17). However, a brake pad 60G (FIG. 19) is used that is fixedly secured to extension flanges 66G and 67G by three rivet-like fasteners 74G. (Compare to FIG. 7.) Notably, brake pad 60G includes a body 90G and a brake liner 91G for increased durability.

Figure 21:
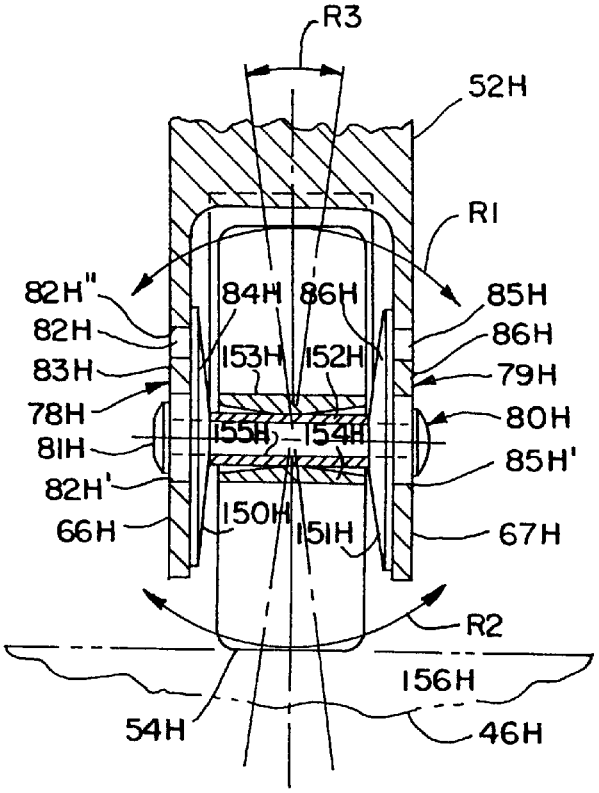
FIG. 21 is a rear end view of the braking system shown in FIG. 20.
Figure 22:
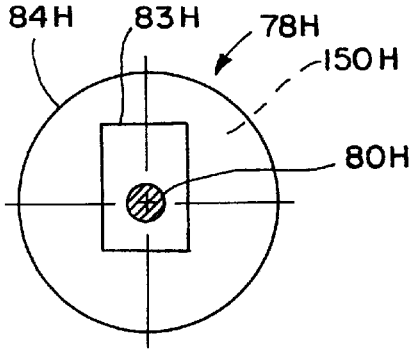
FIG. 22 is a side view of the slide member shown in FIGS. 20 and 21.
Figure 23:
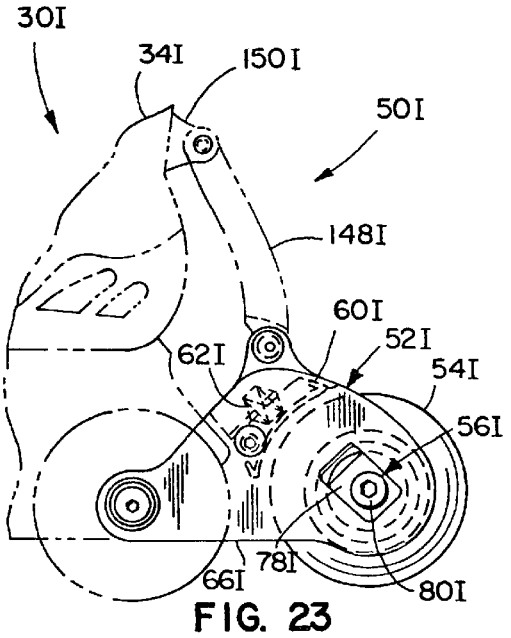
FIG. 23 is a fragmentary side view of yet another braking system embodying the present invention.
Figure 24:
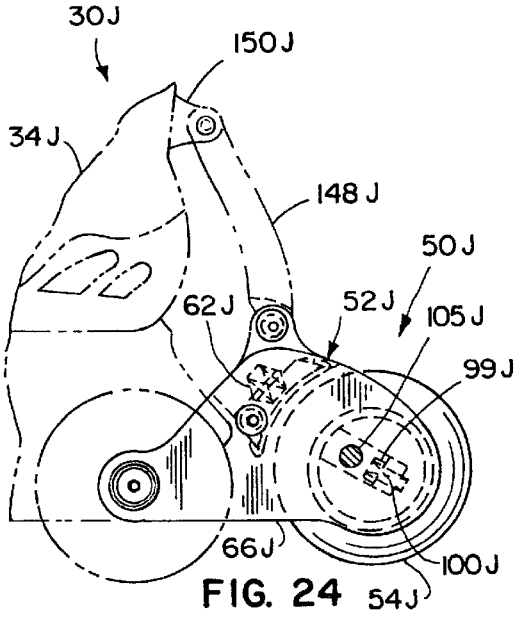
FIG. 24 is a fragmentary side view of yet another braking system embodying the present invention.
Figure 25:
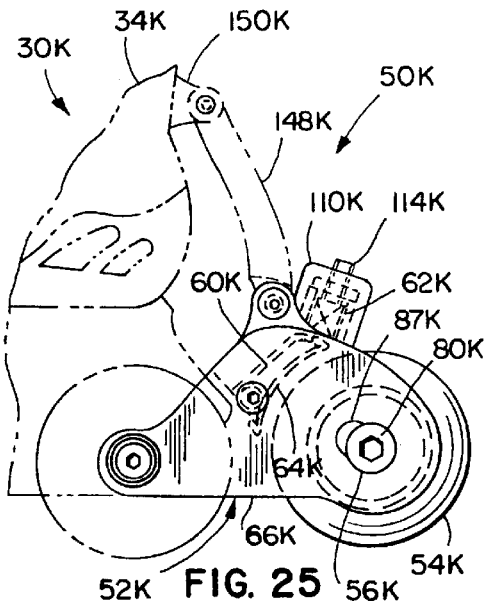
FIG. 25 is a fragmentary side view of yet another braking system embodying the present invention.
Figure 26:
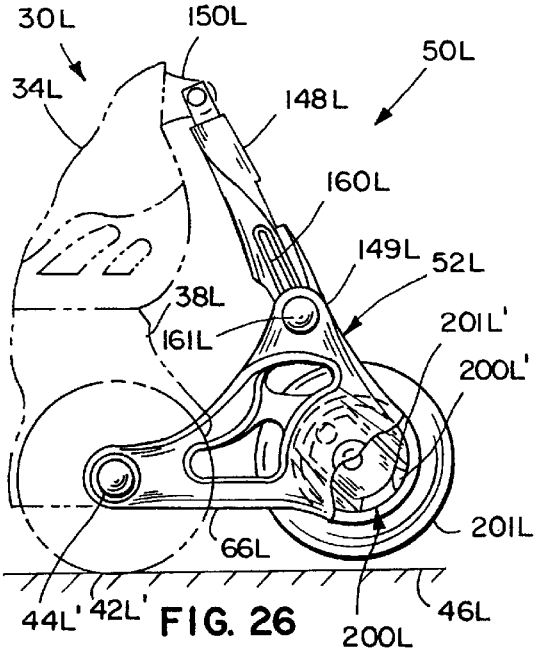
FIG. 26 is a fragmentary side view of an internally operated braking system embodying the present invention, the braking system including an internal braking mechanism, a cuff-actuated link and a pivoted extension.
Figure 27:
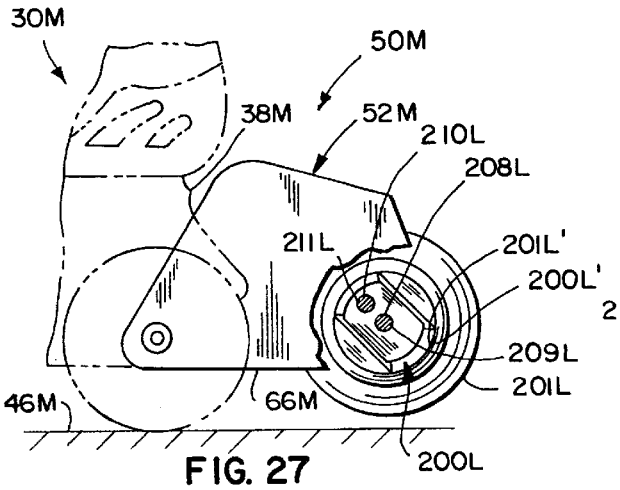
FIG. 27 is a side view of yet another braking system embodying the present invention, the braking system including an internal braking mechanism and a fixed extension.

Braking system 50H (FIGS. 20–22) is closely related to braking system 50 (FIG. 2), except that braking system 50H has been modified to allow braking wheel 54H to pivot from side-to-side as shown by arrows R1 and R2 in FIG. 21. The angle of rotation is indicated by angle R3. Specifically, extension 52H, brake shoe 60H and brake wheel 54H (FIGS. 20–22) are identical to extension 52, brake shoe 60 and brake wheel 54 (FIG. 2). Additionally, slide members 78H and 79H (FIGS. 20–22) are similar to slide members 78 and 79 (FIG. 2). Specifically, slide member 78H further includes a rectangular section 83H for engaging slot 82H in extension flange 66H and a "planar" section or slide washer 84H for engaging the inside surface of flange 66H. However, "planar" section 84H includes a tapered inner surface 150H. Also, slide member 79H includes rectangular section 86H for engaging extension flange slot 85H, and a "planar" section 87H for engaging the inside surface of flange 67H. However, "planar" section 86H includes a tapered inner surface 151H.

A sleeve 152H is mounted on braking wheel axle 80H and a bearing 153H having a double outwardly tapered hole 154H is positioned on sleeve 152H. The double outwardly tapered hole 154H creates a fulcrum at the center 155H of bearing 153H along the central plane 156H of braking wheel 54H. Bearing 153H can pivot on fulcrum point 155H, such that braking wheel 54H is allowed an excursion out of plane 156H by the angle R3. In other words, braking wheel 54H can pivot along the paths defined by arrows R1 and R2 until the axle 80H engages the tapered hole 154H and prevents further rotation. The taper in surfaces 150H and 151H of slide members 78H and 79H allow the braking wheel 54H to pivot the amount of angle R3 without resistance.

The angular movement of braking wheel 54H as shown by arrows R1 and R2 allows braking wheel 54H to engage skate-supporting surface 46H at a perpendicular angle to ground surface 46H even though the in-line roller skate 30H is oriented at an angle to ground surface 46H when the skater is applying the brakes. This advantageously allows maximum contact between braking wheel 54H and ground surface 46H. Thus, braking wheel 54H is not likely to slid or slide. Notably, brake pad 60H engages braking wheel 54H and biases it back to an aligned "vertical" position in extension 52H.

It is noted that various features in the embodiments can be combined and that not all-possible combinations are shown herein. These variations and combinations are also contemplated to be within the scope of the present invention. For example, an in-line roller skate 301 (FIG. 23) includes the cuff actuator shown in FIG. 17 and the braking system shown in FIG. 1. Also, the roller skate 30J (FIG. 24) includes the cuff actuator shown in FIG. 17 and the braking system shown in FIG. 7. Still further, in-line roller skate 30K (FIG. 25) includes the cuff actuator shown in FIG. 17 and the braking system shown in FIG. 11. The operation of these roller skates 30I, 30J and 30K are evident from the discussion above.

INTERNALLY POSITIONED BRAKING SYSTEMS

An in-line roller skate 30L (FIG. 26) includes an extension 52L pivotally connected to wheel-supporting frame 38L at a rear axle 44L' of rear skate wheel 42L'. A cuff-actuated link 148L is pivotally connected at one end to protrusion 149L of extension 52L, and is pivotally connected at its other end to protrusion 150L of cuff support 34L. Link 148L can be fixed in length, but the illustrated link 148L is adjustable by adjustment of threaded extension bolt 160L. The length of link 148L is then set by securing locking nut 161L. Braking system 50L includes extension 52L, and further includes an internally actuated braking mechanism formed by a hub 200L and a braking wheel 201L rotatably supported by hub 200L. As described below, hub 200L and braking wheel 201L include friction-generating surfaces 200L' and 201L', respectively, that generate a braking portion therebetween when the roller skate is pivoted rearwardly to rollingly engage the braking wheel 201L with the skate-supporting surface 46L.

A second in-line roller skate 30M (FIG. 27) includes an extension 52M fixedly connected to the trailing end of frame 38M. Braking system 50M includes an extension 52M, and further includes a hub 200L and a braking wheel 201L (i.e., identical to that shown in FIG. 26). As the roller skate 30M is pivoted rearwardly, the braking wheel 201L rollingly engages the skate-supporting surface 46M causing a braking force to be generated on braking wheel 201L by hub 200L, as described below.

Figure 29:
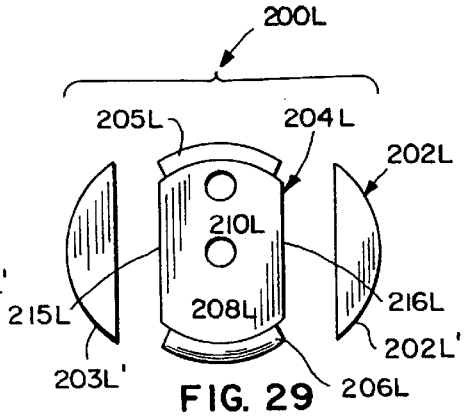
FIG. 29 is an exploded side elevational view of the internal braking system shown in FIG. 28.
Figure 28:
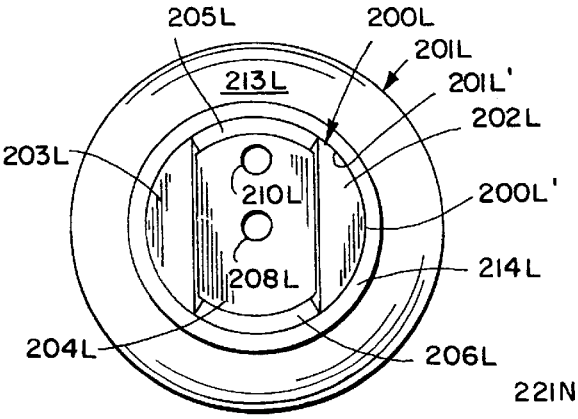
FIG. 28 is an enlarged side view of the internal braking mechanism used in the roller skates shown in FIGS. 26 and 27.
Figure 30:
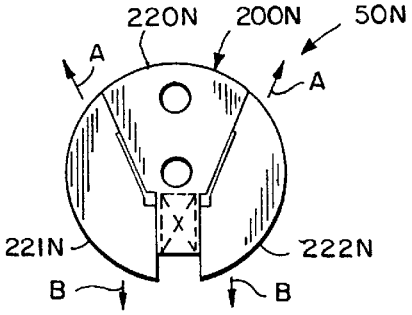
FIG. 30 is a side view of another internal braking system embodying the present invention.
Figure 31:
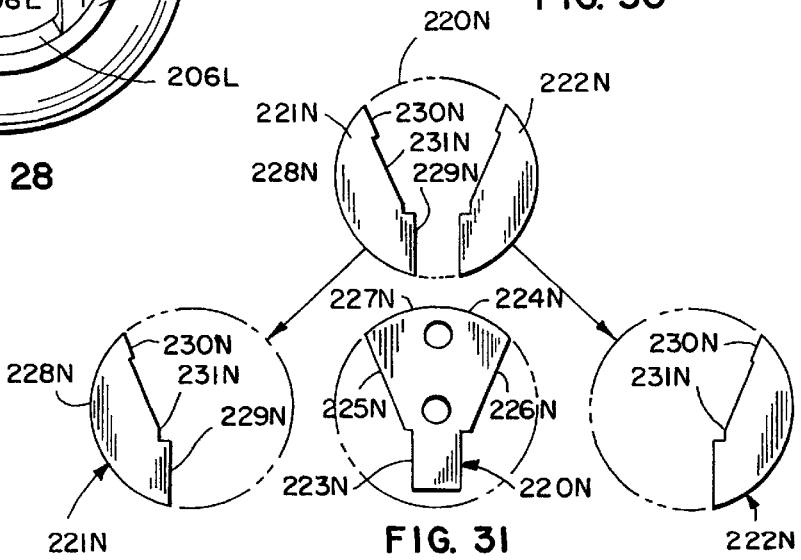
FIG. 31 is an exploded view of the internal braking system shown in FIG. 30.

The internally actuated braking mechanism formed by hub 200L and braking wheel 201L are shown in more detail in FIGS. 28 and 29. Hub 200L includes opposing side members 202L and 203L located on opposing sides of a center piece 204L. Center piece 204L is fixed between the sides of extension 52L and frictionally engaged therewith, but side members 202L and 203L and thus braking wheel 201L are movable relative to center piece 204L to create a braking force when braking wheel 201L is pressed rollingly against hard surface 46L as described below. A pair of friction-generating leather braking shoes 205L and 206L are positioned at the opposing arcuately-shaped ends of center piece 204L. Shoes 205L and 206L can be adhered to center piece 204L or they can be allowed to float thereon. If allowed to float, shoe 206L will slide circumferentially into engagement with side member 202L to cause additional braking action. When assembled together, the outer surfaces 202L' and 203L' of opposing side members 202L and 203L, and leather braking shoes 205L and 206L form a substantially continuous outer circular surface 200L' that mateably slidably engages the inner surface 201L' of braking wheel 201L.

Figure 29A:
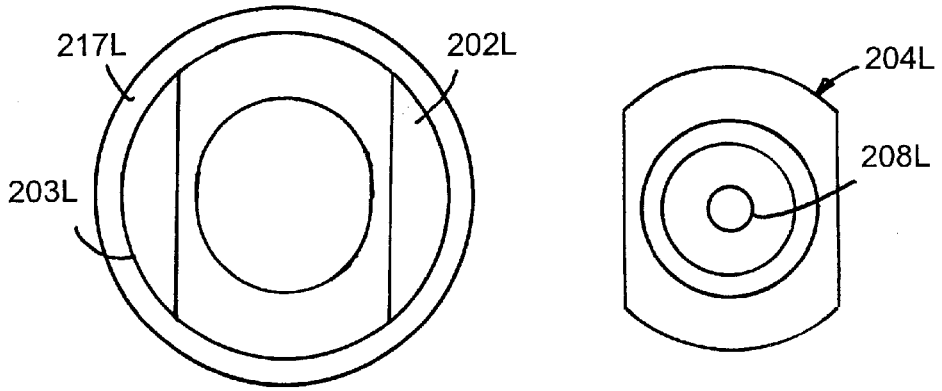
FIGS. 29A and 29B are side views of two variations of FIG. 29.
Figure 29B:
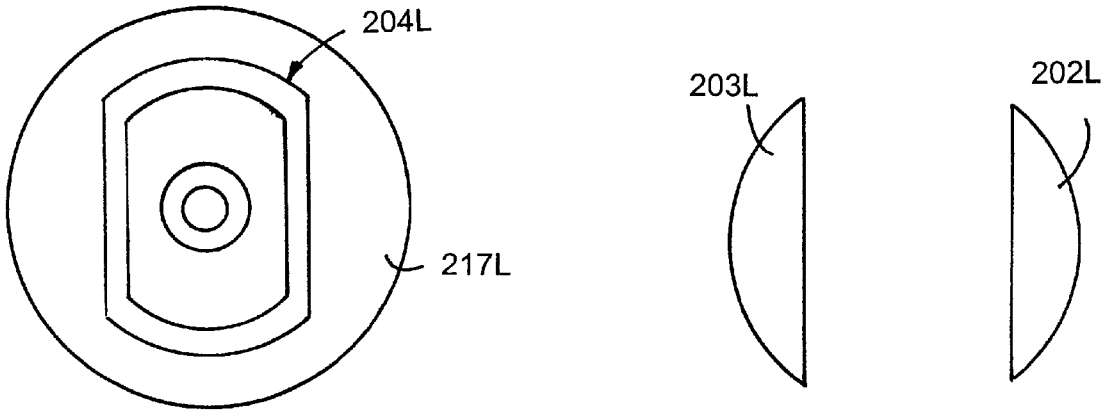
Figure 32:
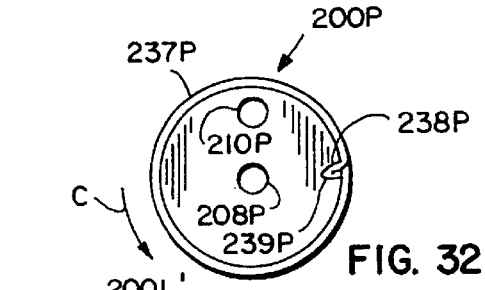
FIGS. 32–39 are side views of several additional internal braking systems embodying the present invention.

Center piece 204L includes a pivot pin supporting transverse hole 208L centrally positioned therein for receiving a fastener or pin 209L, and further includes a second hole 210L spaced from first hole 208L for receiving a second fastener 211L. Fastener 209L secures hub 200L between and through the opposing side members 66L of extension 52L, so that it holds side members 66L of extension 52L together. Fastener 211L engages a slot or depression on the inside of side members 66L in extension 52L to prevent rotation of center piece 204L of hub 200L. Alternatively, fastener 211L can be eliminated, in which case the extension side members 66L are clamped together against center piece 204L to frictionally engage center piece 204L and prevent its rotation. Braking wheel 201L includes a rubber or durable polymeric rim 213L, and further includes a liner/bushing 214L for engaging the outer surface 200L' of hub 200L. It is contemplated that bushing 214L can be manufactured from many different materials, such as bronze, steel, or plastic. Also, the components 202L, 203L, and 204L of hub 200L can be manufactured of different components, such as plastic, aluminum, zinc, or hard rubber. It is further noted that braking shoes 205L and 206L can be made from various materials optimally suited for making braking shoes. Alternatively, this embodiment may incorporate side members 202L and 203L that are attached to a common side wall 217L (FIG. 29A) or center 204L may be attached to side wall 217L (FIG. 29B). Side wall 217L may be formed to be an extension of the wheel-supporting frame.

In operation, when a skater pivots in-line skate 30L (or skate 30M) rearwardly (FIGS. 26–29A), braking wheel 201L and hub side members 202L and 203L are biased in a direction parallel the inner surfaces 215L and 216L defined on opposing sides of center piece 204L. This causes braking shoe 206L to engage inner surface 200L' on hub 200L. Also, since the forces generated by skate-supporting surface 46L on braking wheel 201L are non-parallel the slide surfaces 215L and 216L, there is a degree of twisting or torquing on center piece 204L. This causes opposing members 202L and 203L to engage inner surface 200L' with increased force, thus causing some additional frictional forces to be generated. Notably, center piece 204L can be reversed 180° in roller skate 30L, such that the opposing braking shoe 205L is positioned in a primary braking position. Also, it is noted that the angle defined by center piece 204L with the skate-supporting surface 46L determines the proportion of forces against braking shoes 205L and 206L. Thus, by changing this angle, such as by supporting center piece 204L at a different angular position on a roller skate, the amount of and rate of change of braking force generated by braking system 50L can be customized. Center piece 204L is frictionally retained on the extension at an optimal angle of about 45° to horizontal. Testing has shown that a more vertical angle tends to allow the braking wheel to lockup more quickly than desired, and a more horizontal angel tends to not provide sufficient braking force. Due to the distribution of forces at the 45° angle and the unequal length moment arms on the hub and the braking wheel, the resultant torque caused by the hard surface on the braking wheel has a mechanical advantage over the torque caused by the friction-generating surfaces of the hub, such that the braking wheel does not tend to skid on the hard surface. If greater force is placed on the braking wheel, greater braking forces are generated. However, the mechanical advantage continues to prevent lockup and skidding, which would cause unacceptable flat spots on the braking wheel.

Another braking system 50N (FIGS. 30 and 31) includes a hub 200N that can be used in conjunction with braking wheel 201L and that can be used with either of in-line roller skates 30L or skate 30M as a replacement for hub 200L. Hub 200N includes a modified center piece 220N positioned between a pair of modified opposing side members 221N and 222N. Center piece 220N includes a generally rectangular protruding end section 223N, and further includes an enlarged section 224N defined by a pair of angled side surfaces 225N and 226N. The outer surface 227N is arcuately shaped for mateably engaging inner surface 201L' (FIG. 28). Opposing side members 221N and 222N have an identical shape and are mirror images of each other as positioned against center piece 220N. Side member 221N includes an arcuate surface 228N for engaging inner surface 201L' of braking wheel 201L. Side member 221N further includes a planar surface 229N for engaging one side of protruding end section 223N. Side member 221N further includes an angled surface 230N for engaging angled surface 225N on center piece 220N. A cutaway 231N on angled surface 230N provides clearance along a portion of angled surface 230N between angled surface 230N and inclined surface 225N.

As a skate engages braking wheel 201L against the skate-supporting surface 46L, center piece 220N engages side members 221N and 222N with a wedge-like action to spread apart opposing side members 221N and 222N in directions "A," such that the braking force generated by braking system 50N between surfaces 228N on side members 221N and 222N on the corresponding braking wheel surface 200L' is substantial. Notably, by reversing hub 200N by 180°, the center piece 220N engages side members 220N and 221N in a manner causing a lower rate of increase of braking force as the braking wheel is pressed on a skate-supporting surface. A reason is because, in the reversed position, side members 220N and 221N are moved in directions "B" that are parallel. Thus, center piece 220N does not act like a wedge per se. It is noted that the center piece 220N and arcuate sections 221N and 222N are loosely mounted within braking wheel 201L, such that the sections and pieces tend to move into an unstressed non-braking position when braking wheel 201L is removed from engagement with skate-supporting surface 46L. However, it is also contemplated that a spring can be operably secured transversely in protruding end section 223N for biasing opposing side members 221N and 222N apart to provide an initial braking force.

A one-piece hub 200P (FIG. 32) includes holes 208P and 210P. A strip of leather 237P is wrapped around hub 200P. One end 238P of the leather strip 237P is doubled back and inserted into a notch 239P along the outer surface of hub 200P. The opposing end 240P of the leather strip 237P remains free. When hub 200P is positioned within a braking wheel 201L, the strip of leather 237P is securely held between the outer surface of hub 200P and the inner surface 207L. If braking wheel 201L is rotated in a first direction "C," hub 200P and the strip of leather 237P provides normal braking force on braking wheel surface 201L' to slow the rotation of braking wheel 201L. However, if braking wheel 201L is attempted to be rotated in a direction opposite direction "C," the end 240P of leather strip 237P bunches between inner surface 201L' of braking wheel 201L and the inner surface 200L' of hub 200P, such that the brake system 50P will lockup and prevent further rotation of the braking wheel 201L. This arrangement can be advantageous, such as to permit quick starts by a skater.

Another braking system (FIG. 33) includes a hub 200Q having a notch 242Q therein. A threaded hole 243Q is located in the bottom of notch 242Q, and a strip of leather 244Q is positioned around hub 200Q with the ends 245Q and 246Q positioned in notch 242Q. A fastener 247Q includes an enlarged wedge-shaped washer 247Q' under its head that retains ends 245Q and 246Q in notch 242Q. In braking system 50Q, braking wheel 201Q can be rotated in either direction with a substantially equivalent braking force being applied and without any lockup as noted in regard to hub 200P discussed above. It is noted that the holes 208Q and 210Q receive pins similarly to the holes 208L and 210L on center piece 204L, as discussed above in regard to hub 200L and as shown in FIG. 27.

Figure 33:
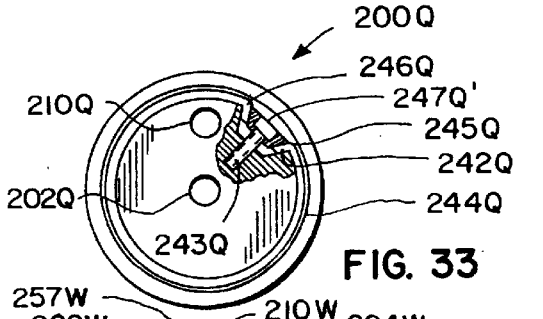
Figure 34:
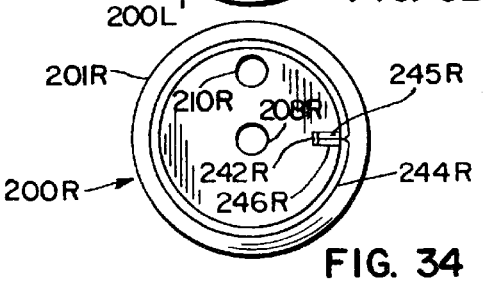
Figure 39:
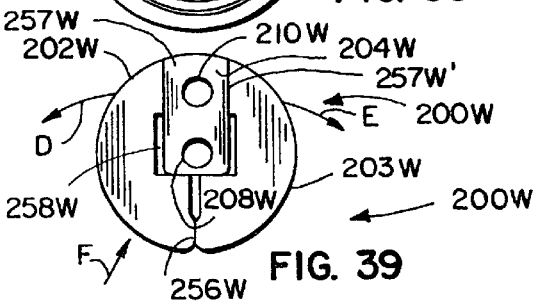
Figure 35:
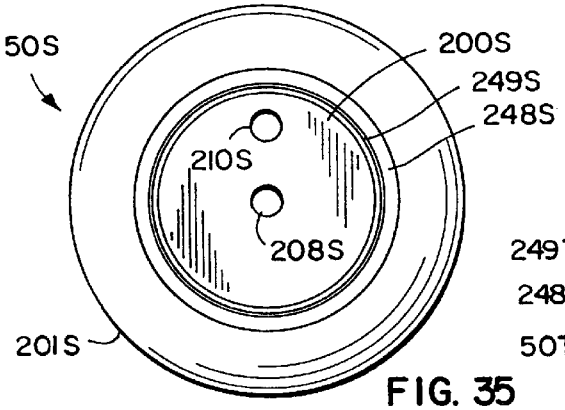
Figure 36:
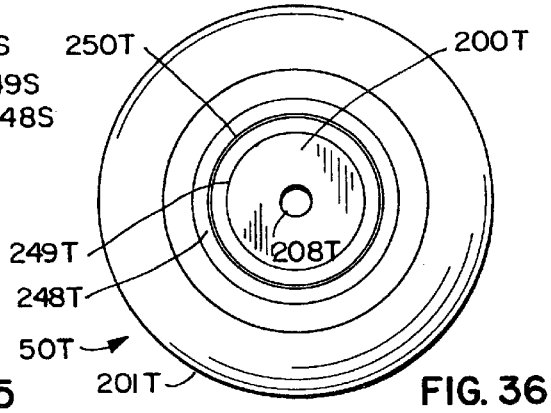
Figure 37:
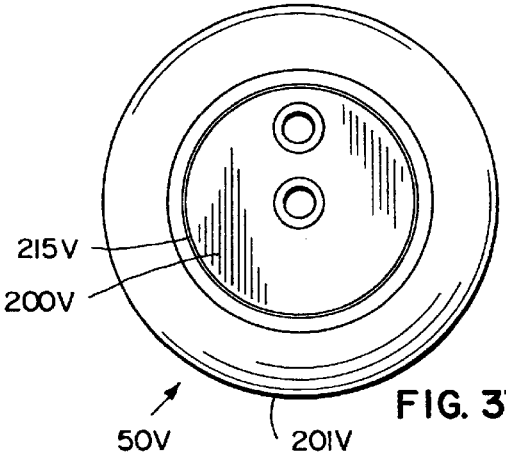

Yet another braking system (FIG. 34) includes a hub 200R and a leather strip 244R not unlike the braking system disclosed in FIG. 33, however the ends 245R and 246R of leather strip 244R are merely tucked into a narrow notch 242R configured to retain the ends of the leather strip 244R without the need for a separate fastener. The ends 244R and 245R are sufficiently sharply deformed and pressed far enough into notch 242R with enough force to retain ends 244R and 245R in notch 242R.

A braking system 50S (FIG. 35) includes a one-piece hub 200S (made of a plastic, aluminum, zinc, polyurethane, or other hard material), a friction-generating material 249S coated around the exterior surface of hub 200S, and a braking wheel 201S including a ring-shaped bushing 248S made of a bronze, steel, or engaging friction-generating material 249T. For example, material 250T may be leather, while material 249T is a composite heat conductive material.

In braking system 50U (FIG. 37), both hub 200U and braking wheel 201U comprise a relatively hard, incompressible, rubber material or urethane material. A ring of braking material 251U can be positioned therebetween, if desired, such as a viscous or a semi-hardened non-adhereable material to prevent bonding of hub 200U to braking wheel 201U when the braking system 50U becomes hot during use. As braking wheel 201U is engaged with a hard surface, it is forced against hub 200U. The incompressible material of hub 200U is deformed in a first direction, and thus bulges in a second direction orthogonal to the first direction. This causes portions of hub 200U in the "bulging" areas of hub 200U to press against braking wheel 201U, thus causing a braking force on braking wheel 201U. Notably, braking wheel 201U may itself undergo some deformation/bulging during braking.

Figure 38:
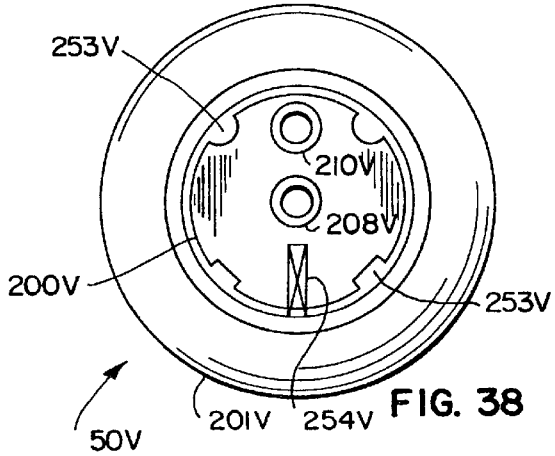

In FIG. 38, hub 200V includes dirt grooves 253V for receiving dirt and abraded particles to help provide a continuous and dependable braking action by the braking system of 50V. Also, a spring or screw 254V is inserted in a side of hub 200V to ensure that hub 200V generates some initial braking force on braking wheel 201V at all times. The screw or spring 254V is replaceable or stretchable, such that the resulting initial braking force is adjustable.

Hub 200W (FIG. 39) includes a center piece 204W positioned between a pair of opposing side members 202W and 203W. Opposing side members 202W and 203W include abutting surfaces 256W forming a pivot, and further include spaced apart surfaces 257W and 257W' forming camming surfaces. Center piece 204W is positioned between camming surfaces 257W and 257W'. As a skater pivots a roller skate 30W rearwardly, such that braking wheel 201W contacts a skate-supporting surface, the direction of forces "F" on braking wheel 201W is misaligned with a centerline on center piece 204W, such that the center piece 204W in effect twists within/between opposing side members 202W and 203W. A lower portion of center piece 204W pivots into a recess 258W in side members 202W (or 203W) allowing the sides of center piece 204W to twist and cam against cam surfaces 257W. This causes opposing side sections 202W and 203W to spread apart in directions "D" and "E." In turn, this causes an increased friction due to the increased force of opposing side sections 202W and 203W against the inner surface 207W of braking wheel 201W. Thus, in-line roller skates are provided with braking systems that include a brake pad and a dynamic braking wheel operably supported on a wheel frame extension. The response of the braking wheel to engagement with a skate-supporting surface and the direct dynamic movement of the braking wheel into the brake pad and/or the hub gives improved control over braking and an improved feel for braking. In one aspect, the braking system is external to the braking wheel. In another aspect, the braking system is internal to the braking wheel, such that the braking system is substantially a self-contained unit, such as for attachment to a roller skate.

It is contemplated that the scope of the present invention of braking systems includes other applications and methods of use. For example, the present braking systems could be used on quad roller skates having two front and two rear wheels arranged in a rectangular pattern, with the braking wheel being a fifth wheel (or fifth and sixth wheels) positioned rearwardly of the axis of rotation of the two rear wheels. Also, the present braking systems could be used on skate boards or other wheeled weight-carrying articles or apparatus. Still further, the present braking systems could be used on a stationary device, such as a conveyor for moving objects along at a controlled rate. The material handling conveyor would include a plurality of rotatable wheels for rollingly supporting and moving along packages or boxes at the controlled rate. Notably, the conveyor could be any of a variety of different types, such as powered conveyors or gravity feed conveyors. Also, the wheels could be arranged in a variety of patterns and supported in a variety of ways. Notably, the wheels could be any of the wheels disclosed in this application, and the conveyor could incorporate any of the braking systems disclosed herein. In conveyor applications, the internal braking systems are believed to be particularly useful due to the ability to preassemble them and install them as a self-contained unit.

NON-SYMMETRICAL HUB

Braking system 50Y (FIG. 40) has a non-symmetrical hub 200Y which includes dirt grooves 253Y for receiving dirt particles to help provide continuous and dependable braking action. In this embodiment, the term "serration" includes serrations, grooves, knurls, teeth, slots and rough surfaces. This embodiment further includes serrations 262Y for increased braking action. A strip 263Y of material has an inner layer 248Y with desired friction-generating characteristics and is placed freely between hub 200Y and braking wheel 201Y to allow only minimal friction while braking system 50Y is not in use. Also, the strip of material 263Y can be multilayered or can comprise a single material. Alternatively, braking system 50Y can include a ring-shaped bushing similar to that of braking system 50S. When braking system 50Y is engaged, the force of braking wheel 201Y against the skating surface causes strip 263Y or bushing 248Y to be forced into communication with serrations 262Y of hub 200Y causing the strip to become temporarily fixed to the hub, thus causing friction between strip 263Y and the inner surface of wheel 201Y creating a braking action. Because the strip of material is not attached to wheel 201Y, when there is no pressure or braking wheel 201Y, the free rotation of the strip allows cooling of the strip and distributes the use and wear of strip 263Y.

BRAKING WHEEL AS REAR IN-LINE WHEEL

A skate with a rear braking wheel attached to the original wheel-supporting frame is shown in FIG. 41. In this alternative, the original rear in-line wheel is removed from the wheel-supporting frame 38 and replaced by the brake mechanism. Other original wheels may be removed, but at least two "riding" wheels must remain. One of the above-described internal brake wheel systems is attached in the rear wheel position of the wheel-supporting frame. Many commercial in-line skates are equipped with a "rocker" system on each of its wheels which allows each wheel to be independently moved up or down slightly on the frame with respect to each other. In this embodiment of the present invention, at least two of the remaining "riding" wheels 42 would be rocked "down" and the braking wheel 54 would be rocked "up," so that when skating, the "riding" wheels 42 are all touching the ground and the braking wheel does not touch the ground or only lightly touches the ground. When the user wishes to have braking, the skate needs to be tipped back slightly to engage the braking wheel with the skating surface. This embodiment allows for quick and responsive braking, which is desired in hockey and other fast-paced skating sports.

To achieve even more clearance between the rear braking wheel 54 and the skating surface than rocking provides, an adjustable pivot extension 53 may be added to the wheel-supporting frame. The side wall of the braking system may form pivot extension 53 (see FIG. 42). A cuff linkage system similar to the ones described below may be used to activate the pivot extension for more ground clearance.

LINKAGE SYSTEMS

Figure 43:
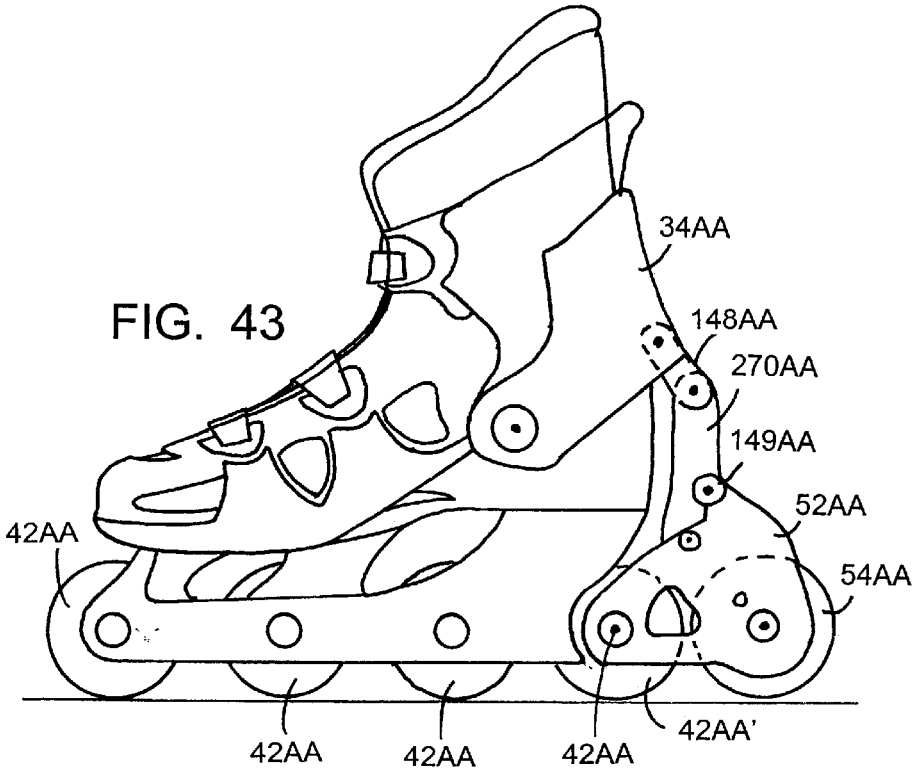
FIG. 43 is a side view of an in-line skate with a braking system embodying the present invention where the braking system is not engaged.
Figure 44:
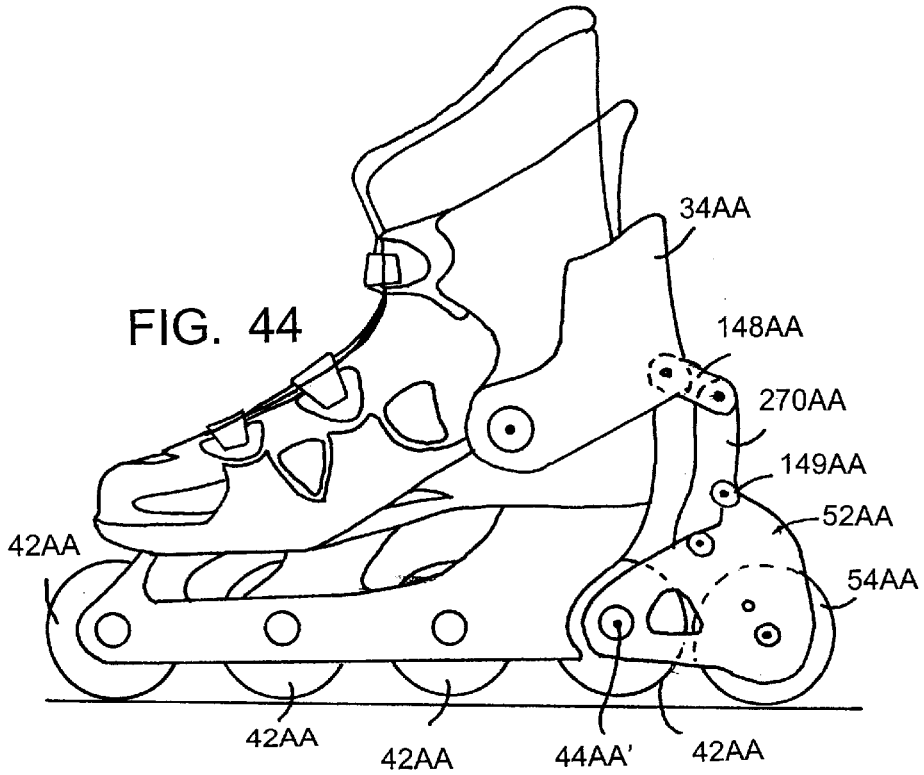
FIG. 44 is a side view of an in-line skate with the braking system of FIG. 43 where the braking system is engaged with, such a strong force that the rear of the skate is lifted.

FIG. 43 shows an embodiment of the present braking system invention that includes a short upper link 148AA attached pivotally to cuff 34AA. Upper link 148AA is further pivotally attached to a long lower link 270AA. Lower link 270AA is fixedly (non-rotatably) attached to an extension or braking subframe 52AA that houses braking wheel 54AA. The arrangement of upper link 148AA, lower link 270AA, extension 52AA, and the roller skate shoe forms a four-bar linkage that provides mechanical advantage when actuating the braking wheel 54AA. Specifically, when cuff 34AA is rocked back by the leg of the user, upper link 148AA is forced against lower link 270AA causing upper link 148AA to jut rearwardly/outwardly, thus causing lower link 270AA to move outward and downward relative to the boot of the skate. (See FIG. 44.) Extension 52AA rotates about axle 44AA' causing braking wheel 54AA to engage the skating surface. Braking wheel 54AA is equipped with one of the above-mentioned internal braking systems. As braking wheel 54AA engages the skating surface, the braking system engages causing the skate to be braked. Notably, if the skating surface is engaged with enough force, all of wheels 42AA with the exception of the front wheel can be lifted off of the skating surface. This is due to the mechanical advantage provided by the linkage system. The release of the rear wheels 42AA from the skating surface results in more friction force on the front and rear wheels, causing superior braking action while also facilitating quick but controlled turns or alignment and stability for higher and lower speed straight stopping. This allows a skater to turn sharply and quickly, such as when the roller skate is used for hockey or figure skating. The linkage system of the present embodiment can be designed to lock if the user's leg is rocked rearward far enough. In such case, the linkage system will unlock by rocking the user's leg forward, and thus moving the cuff forward and the braking wheel upward.

Figure 45:
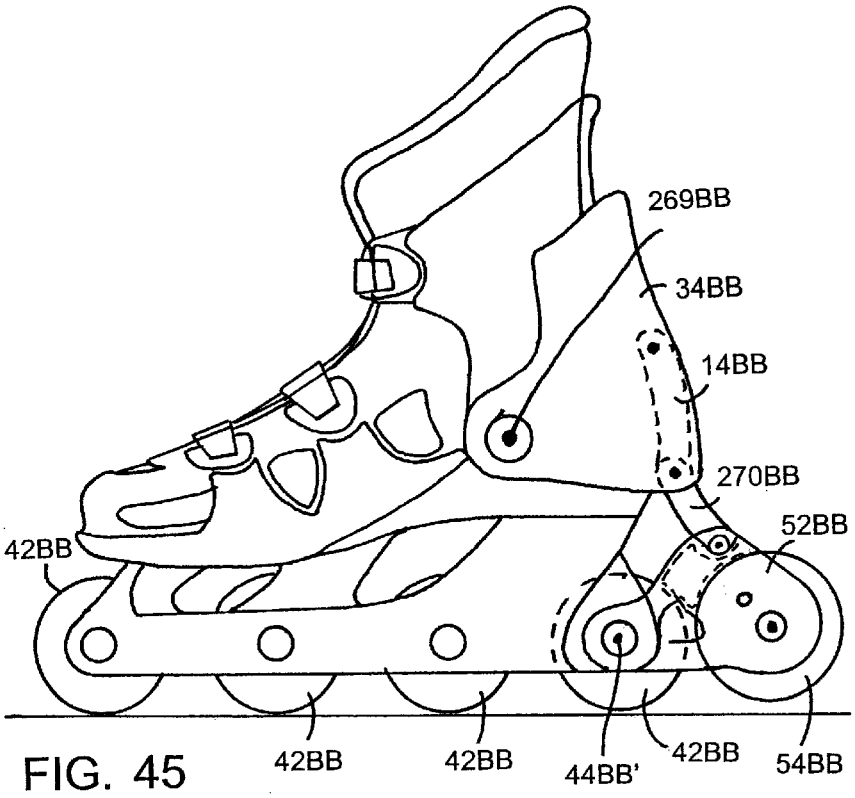
FIG. 45 is a side view of a modified in-line skate with a braking system embodying the present invention that is not unlike the embodiment of FIG. 43 and where the braking system is not engaged.
Figure 46:
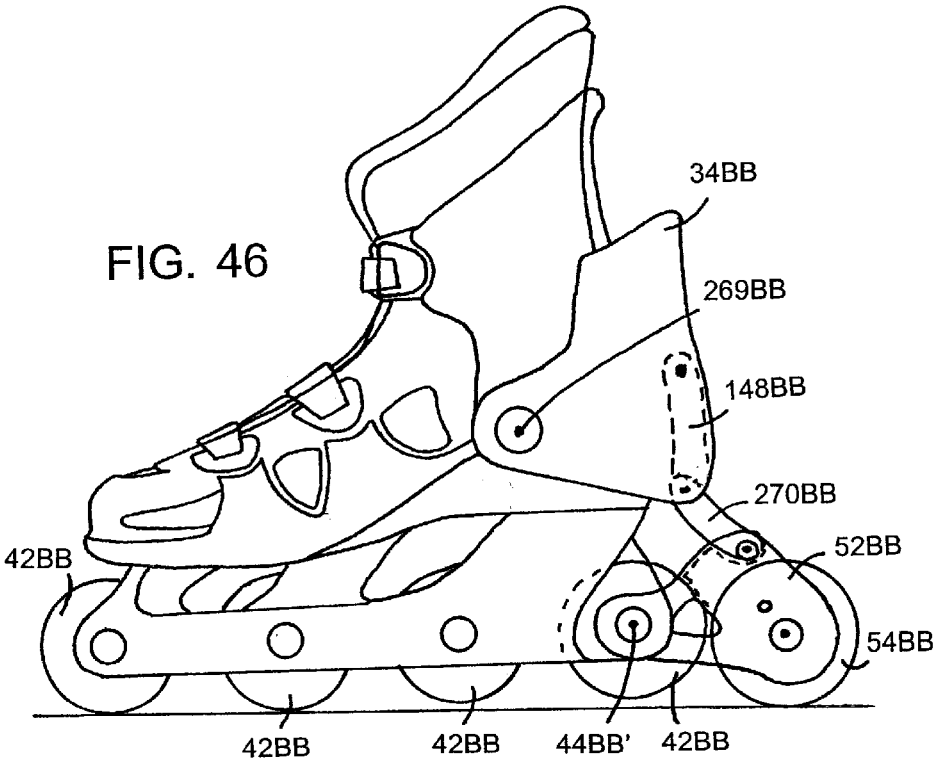
FIG. 46 is a side view of the in-line skate of FIG. 45 where the braking system is engaged.

FIG. 45 shows another embodiment of the present braking system invention which includes an upper link 148BB fixedly attached to cuff 34BB. Upper link 148BB is further pivotally attached to lower link 270BB. This braking system is similar to the braking system of FIGS. 43 and 44, but upper link 148BB and lower link 270BB in this embodiment are approximately the same length. Lower link 270BB is fixedly attached to an extension 52BB that houses braking wheel 54BB. Cuff 34BB pivots around point 269BB. When cuff 34BB is rocked back about pivot 269BB by the leg of the user, upper link 148BB is forced against lower link 270BB, causing upper link 148BB to move downward and causing lower link 270BB to move downward and outward relative to the boot of the skate (FIG. 46). Extension 52BB rotates about axle 44BB' causing braking wheel 54BB to engage the skating surface. Braking wheel 54BB is equipped with one of the above-mentioned internal braking systems. As braking wheel 54BB engages the skating surface, the brake system engages causing the skate to slow. If the skating surface is engaged with enough force, all of wheels 42BB with the exception of the front wheel can be lifted off of the skating surface similarly to FIG. 44. Again, due to the increased friction, this allows a skater to turn sharply, such as when the roller skate is used for hockey or figure skating, or allows alignment and stability for higher and lower speed straight stopping. The required force to move the cuff is many times less than the resultant brake wheel force against the skating surface. This is due to the relationship of the linkage pivot points to each other so as to develop the maximum mechanical advantage to multiply the initial cuff force.

Figure 47:
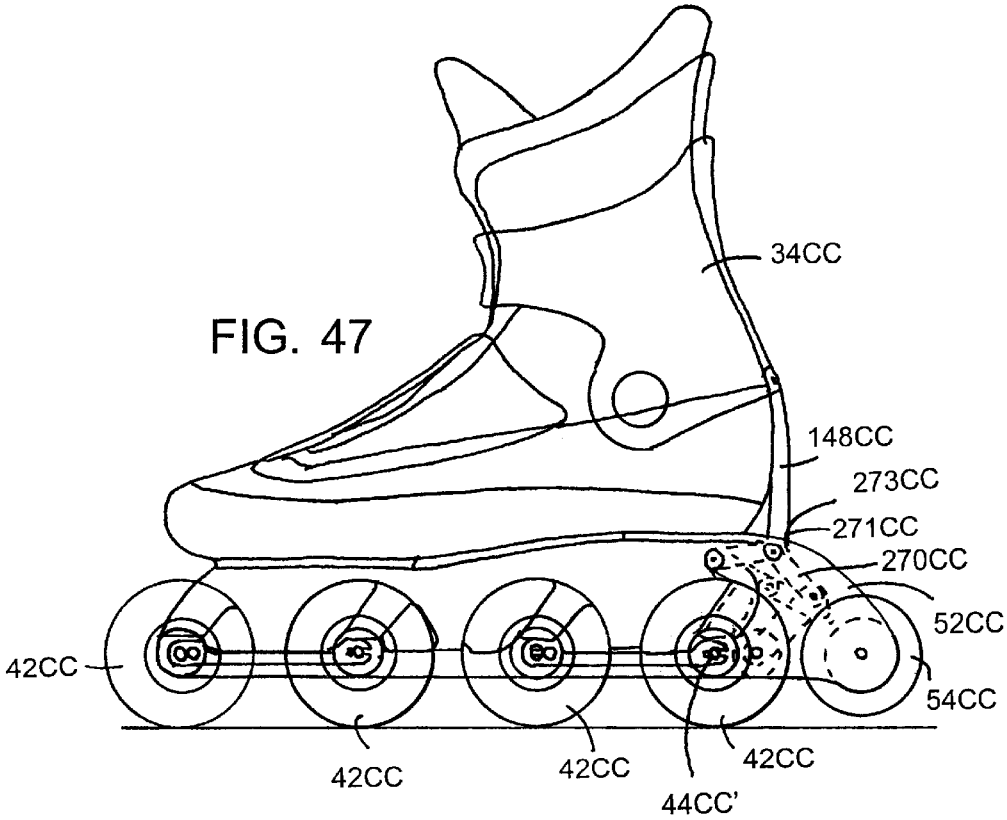
FIG. 47 is a side view of a modified in-line skate with a braking system embodying the present invention that is not unlike the embodiment of FIG. 45 and where the braking system is not engaged.
Figure 48:
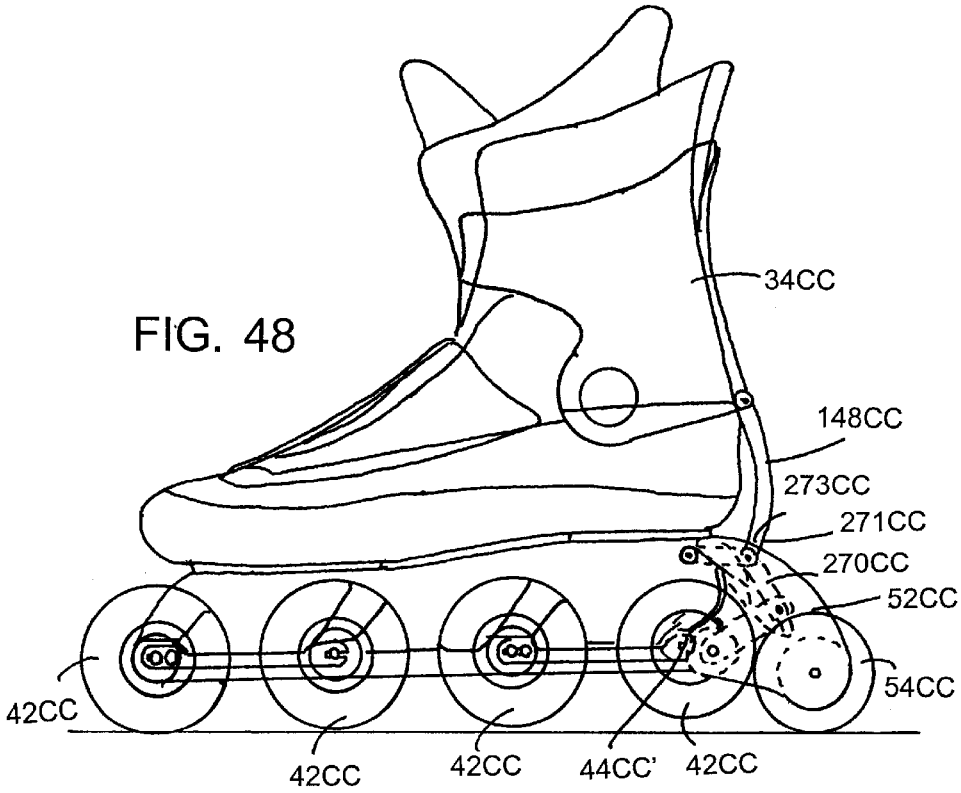
FIG. 48 is a side view of the in-line skate of FIG. 47 where the braking system is engaged.

FIG. 47 shows yet another embodiment of the braking system invention including a long upper link 148CC pivotally attached to cuff 34CC. Upper link 148CC is further pivotally attached to a short lower link 270CC. A third link 271CC is attached at pivot point 273CC where upper link 148CC and lower link 270CC attach. Link 271CC is attached at its other end to wheel-supporting frame 38CC creating yet another pivot point. Lower link 270CC is pivotally attached to an extension 52CC which houses braking wheel 54CC. When cuff 34CC is rocked back by the leg of the user, upper link 148CC is forced against lower link 270CC, causing pivot point 273CC and lower link 270CC to move downward and outward relative to the boot of the skate (FIG. 48). This braking arrangement provides a significant mechanical advantage because as the lower links 270CC and 271CC are forced downwardly, they pivot toward an aligned position. The closer links 270CC and 271CC are to the aligned position, the greater the mechanical advantage, and the greater the force generated for moving the extension 52CC. Extension 52CC rotates about axle 44CC' causing braking wheel 54CC to engage the skating surface. Braking wheel 54CC is equipped with one of the above-mentioned internal braking systems. As braking wheel 54CC engages the skating surface, the brake system engages causing the skate to slow. Again in this embodiment, if the skating surface is engaged with enough force, all of wheels 42CC with the exception of the front wheel can be lifted off of the skating surface. Again, due to the increased friction, this allows a skater to turn sharply, such as when the roller skate is used for hockey or figure skating or allows alignment and stability for higher and lower speed straight stopping. The linkage system of the present embodiment will lock if the user's leg is rocked rearward far enough. The linkage system can be unlocked with minimal force by rocking the user's leg forward, and thus moving the cuff upward. Advantageously, the linkage of this embodiment is low, such that the linkage can be more easily shielded from debris or hidden for aesthetics. The required force to move the cuff is many times less than the resultant brake wheel force against the skating surface. This is due to the relationship of the linkage pivot points to each other so as to develop the maximum mechanical advantage to multiply the initial cuff force.

Figure 49:
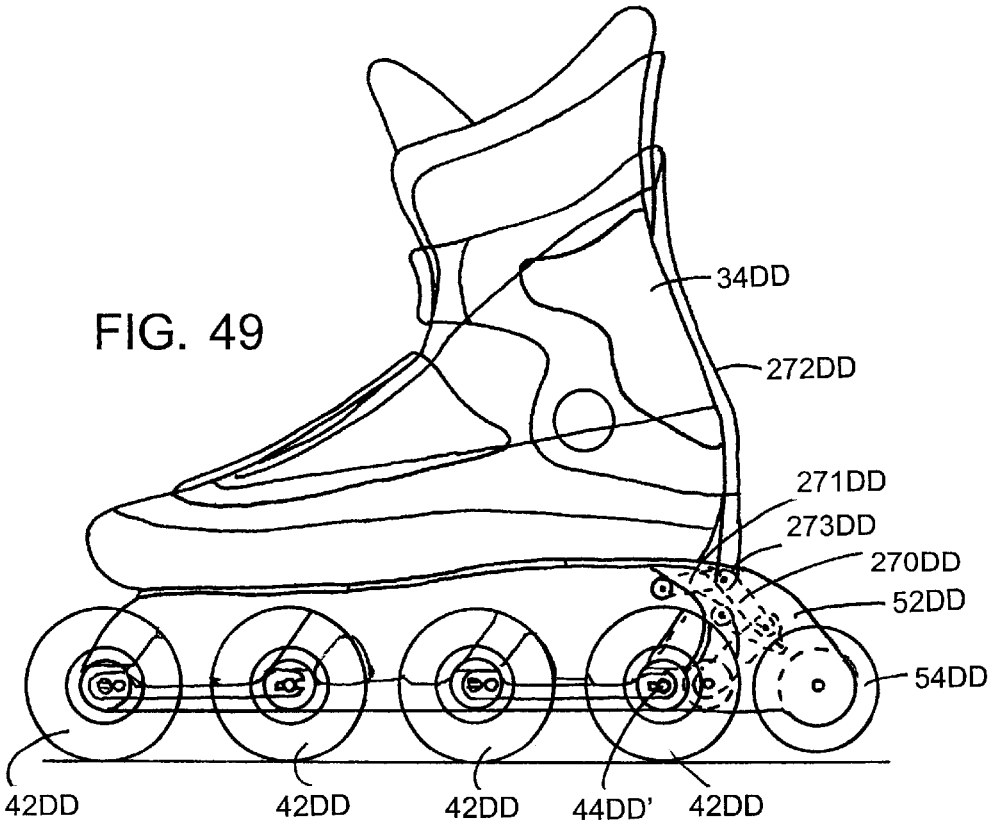
FIG. 49 is a side view of a modified in-line skate with a braking system embodying the present invention that is not unlike the embodiment of FIG. 47 and where the braking system is not engaged.
Figure 50:
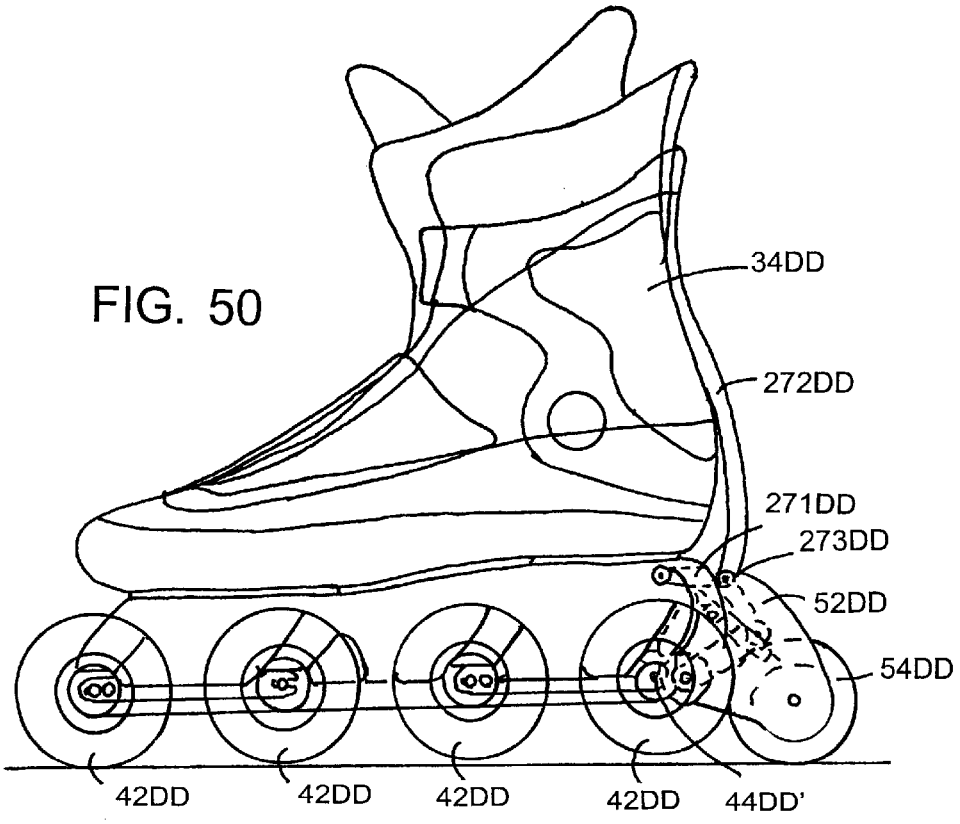
FIG. 50 is a side view of the in-line skate of FIG. 49 where the braking system is engaged.

Another embodiment of the present invention is shown in FIG. 49. This embodiment (FIG. 49) is similar to that embodiment of FIG. 47, but the upper link is made flexible in this embodiment. Specifically, the embodiment of FIG. 49 includes a cuff 34DD having a flexible arm 272DD. Arm 272DD extends from cuff 34DD and is attached to a short lower link 270DD. A third link 271DD is attached at pivot point 273DD where upper link 272DD and lower link 270DD attach. Link 271DD is attached at its other end to wheel-supporting frame 38DD creating yet another pivot point and creating extra leverage and support to the braking system. Lower link 270DD is pivotally attached to an extension 52DD which houses braking wheel 54DD. When cuff 34DD is rocked back by the leg of the user, arm 272DD is forced against lower link 270DD, causing upper link 148DD to bend slightly and causing pivot point 273DD and lower link 270DD to move downward and outward relative to the boot of the skate (FIG. 50). Extension 52DD rotates about axle 44DD' causing braking wheel 54DD to engage the skating surface. Braking wheel 54DD is equipped with one of the above-mentioned internal braking systems. As braking wheel 54DD engages the skating surface, the brake system engages causing the skate to slow. The required force to move the cuff is many times less than the resultant brake wheel force against the skating surface. This is due to the relationship of the linkage pivot points to each other so as to develop the maximum mechanical advantage to multiply the initial cuff force. Due to increased friction, alignment and stability result for higher and lower speed straight stopping.

Figure 51:
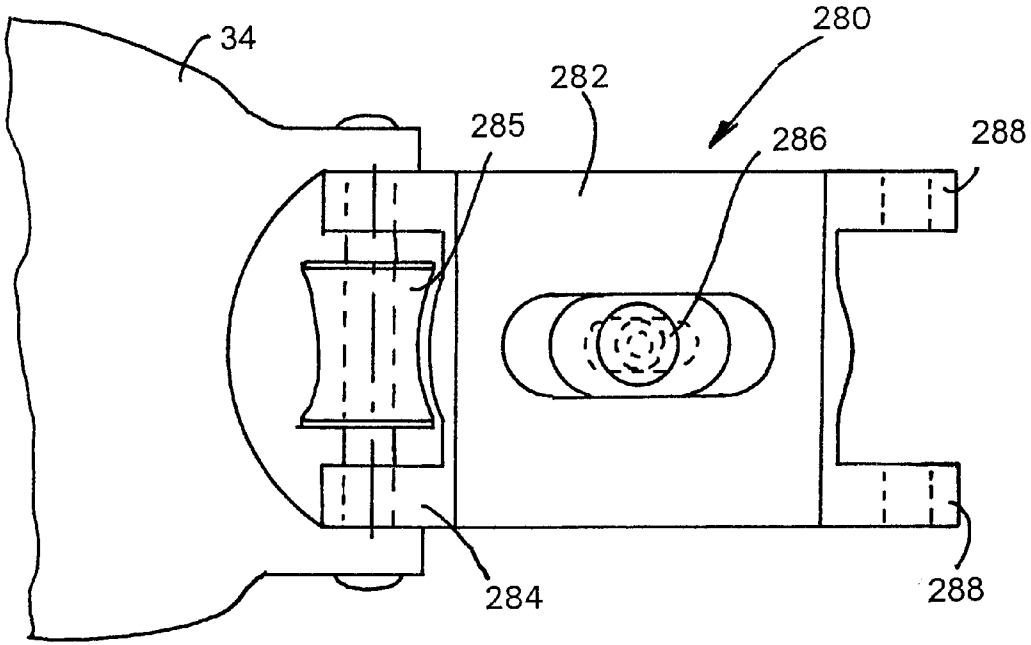
FIG. 51 is a top view of an adjustable toggle assembly for use as a link in any of the previously disclosed braking system that uses links.
Figure 52:
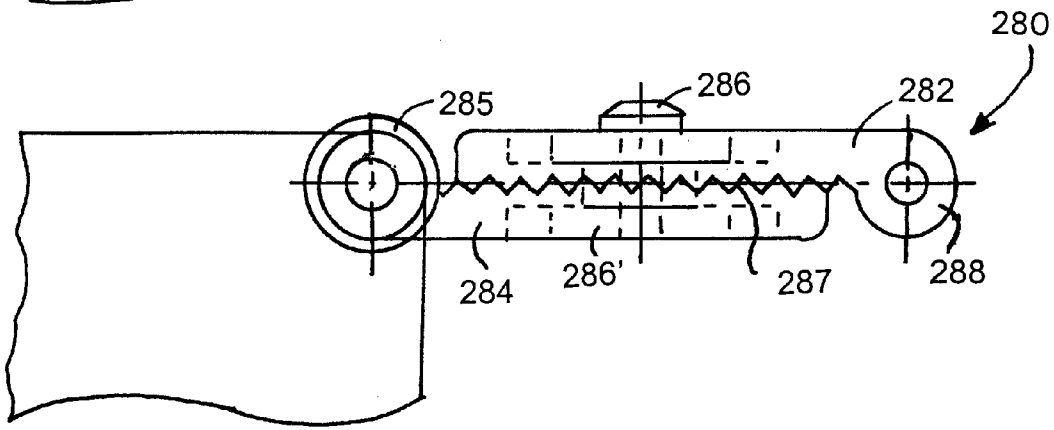
FIG. 52 is a side view of the adjustable toggle link assembly in FIG. 51.
Figure 53:
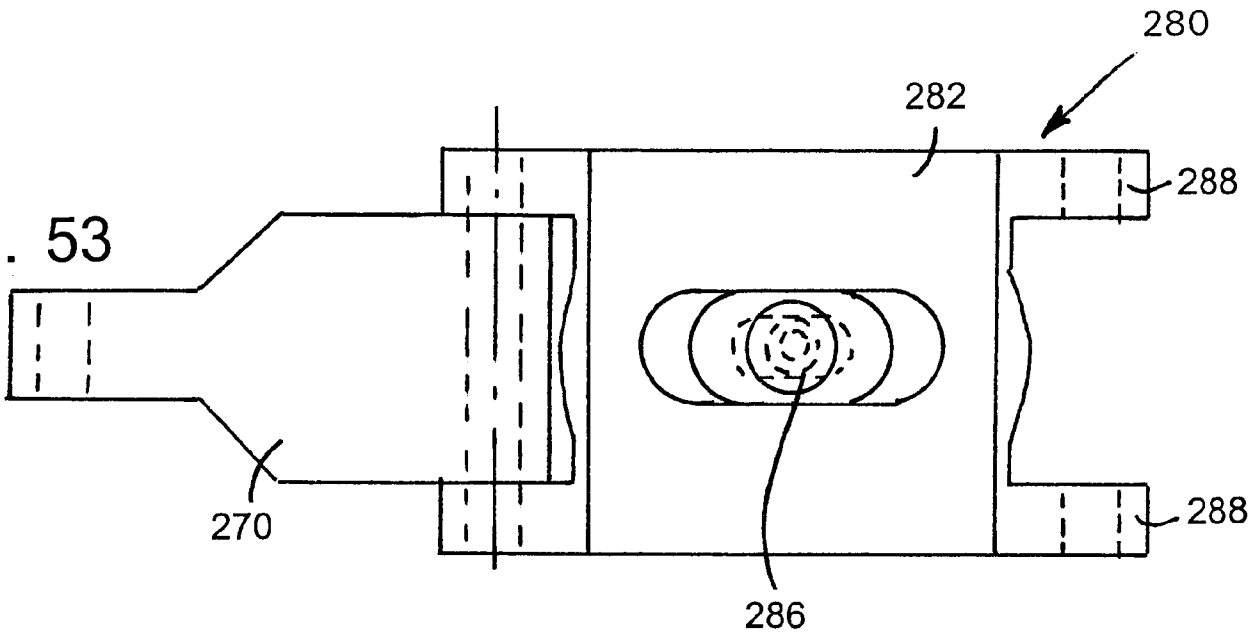
FIG. 53 is a top view of an adjustable toggle assembly for use as a link in any of the previously disclosed braking systems that use links.
Figure 54:
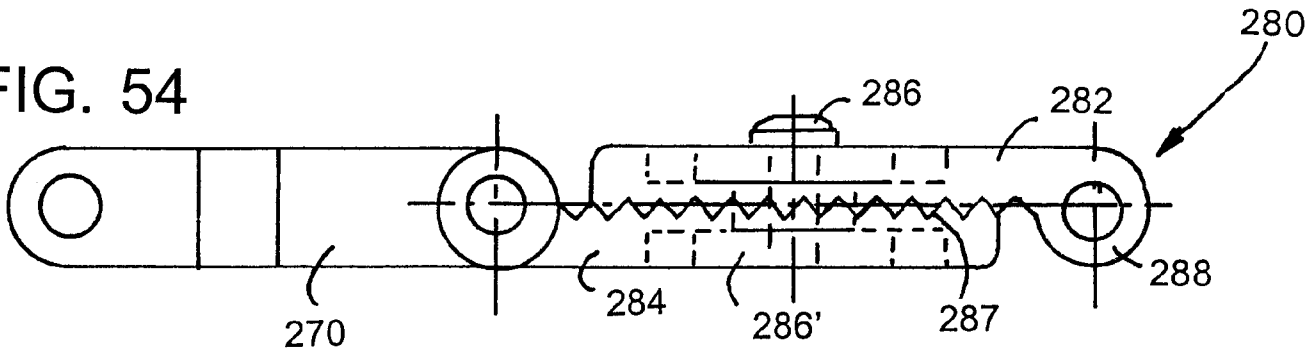
FIG. 54 is a side view of the adjustable toggle link assembly in FIG. 53.

An adjustable link assembly 280 for the braking system of the present invention is shown in FIGS. 51–54. Adjustable link assembly 280 can be used in any of the aforementioned linkage systems. The assembly includes top member 282, which is attached to a bottom member 284 by a screw 286 and nut 286' for holding the jagged portions 287 on both the top member and the bottom member together. In one alternative of link assembly 280, link assembly 280 attaches directly to the cuff and includes a pivotal roller 285 which, for example, can roll against the rear surface of the boot of the in-line roller skate (FIGS. 51 and 52). This sliding/rolling movement is important since, as a skater leans rearwardly to move his/her cuff to actuate the present braking system, the cuff is reinforced as it moves rearwardly and downwardly along the rear/heel of the boot. Thus, the linkage (e.g., link 148AA) must be made to slide/roll on the rear/heel of the boot to backup the force generated between the linkage and brake of the braking system. The slide/roll system also absorbs force returning from the skating surface to the braking system. The roller alternative is used with the "mid-toggle" linkage system shown in FIGS. 45 and 46. The roller allows less marring of the boot and greater force reaching the braking wheel from the cuff. In another alternative, link assembly 280 is attached to another link in the linkage system (FIGS. 53 and 54). In this alternative, no roller is needed. Top member 282 can be attached to braking wheel 54 by attaching hub 200 between opposing attachment elements 288. Link assembly 280 is adjusted by removing or loosening screw 286 and nut 286', thus allowing top member 282 to move away from bottom member 284. Thereafter, top member 282 can be adjustably moved along bottom member 284 to either lengthen or shorten the amount of space between braking wheel 54 and the skating surface, thereby adjusting the travel of braking wheel 54.

FIG. 55 shows the braking system of the present invention with a mechanism to allow a wheel or tire portion 77 to be easily snapped onto the braking drum. The drum of the wheel includes annular flanges 292 on its lateral sides and is made of bronze, aluminum, or a composite material suitable for generating friction with minimum wear. Annular flanges 292 are sufficiently short to allow flexible tire portion 77 to be easily snapped on, while being long enough and resilient enough to hold wheel or tire portion 77 on the hub securely after the snapping engagement even when a large force is encountered. The drum may further include serrations or grooves to assure that no unwanted slipping of the braking wheel or tire occurs when the braking system is in use. The tire can be made of a flexible polyurethane or other similar flexible but durable material. The resiliency/flexibility of the tire material partially determines the height of the annular flanges 292.

It is noted that the above-discussed linkage mechanisms could also be used on other skate braking systems, even those using totally different braking devices, such as with a friction/skid block-type brake.

FURTHER MODIFICATION

Figure 56:
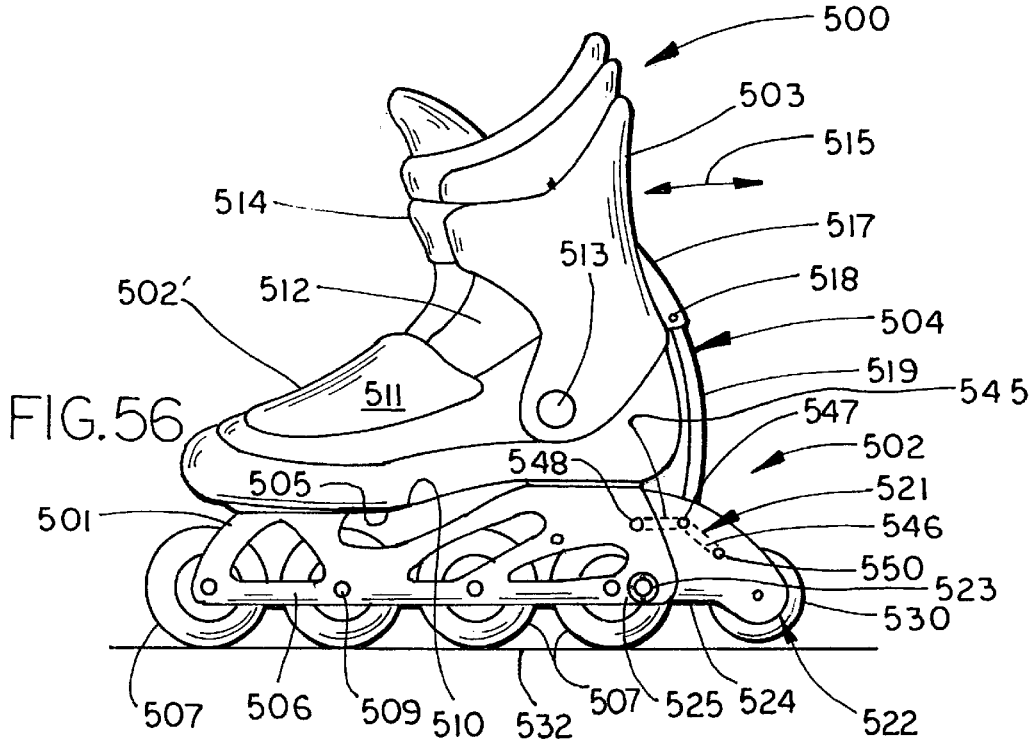
FIG. 56 is a side view of a roller skate embodying the present invention, including a cuff-actuated braking mechanism having a toggle linkage for operably moving a frame extension and braking wheel for providing mechanical advantage.
Figure 58:
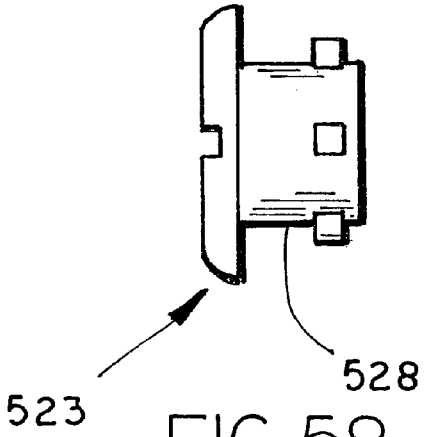
FIGS. 58 and 59 are side and end views of a partial-turn pivot pin shown in FIGS. 56 and 57.
Figure 59:
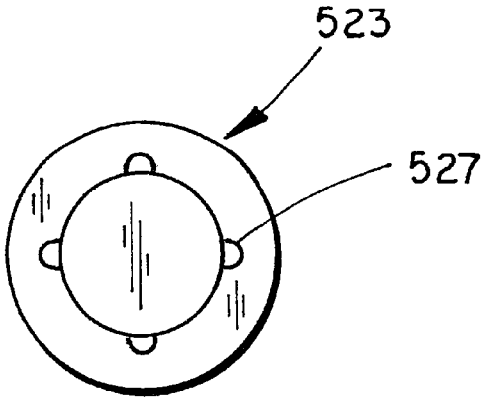
Figure 60:
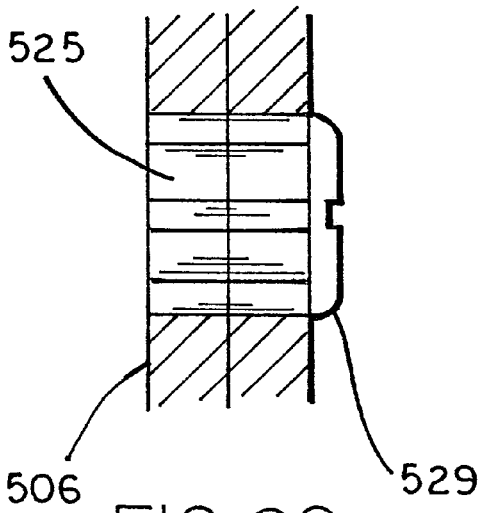
FIGS. 60 and 61 are fragmentary side cross-sectional and inside-out views of the configured hole for receiving the partial-turn pivot pin shown in FIGS. 58 and 59.

An in-line roller skate 500 (FIG. 56) incorporating the present inventive improvement includes a wheeled frame 501, a shoe 502' supported on the wheeled frame 501, and a braking mechanism 502. The shoe 502' includes a cuff 503 that can be flexed to move an actuator linkage 504 for actuating the brake mechanism 502. Advantageously, the brake mechanism 502 provides mechanical advantage and the movement of the cuff 503 provides a controllable actuating system, such that the configuration results in a controllable but highly effective and leveraged braking force, with the braking force increasing exponentially as the cuff is moved rearwardly.

In-line roller skates are well-known in the art, and a more detailed description of them than is already provided is not necessary for an understanding of the present invention. Nonetheless, an in-line roller skate 500 is briefly described as follows. The wheeled frame 501 includes a shoe support plate 505, and downwardly extending side frame flanges 506. Multiple wheels 507 are supported between the side frame flanges 506 on axle pins 509. The shoe 502' is secured on the shoe support plate 505, and includes a sole 510, boot section 511, and ankle support section 512. The cuff 503 is attached to the boot section 511 at pivot 513, and extends upwardly around the ankle support section 512. The boot section 511 is resiliently flexible and includes quick connect fasteners 514 that can be snappingly fastened to securely capture a person's foot for skating. When captured, the person's foot cannot be removed from the boot section 511. Nonetheless, the person is able to flex his/her ankle and calf to move the cuff 503 a distance fore-to-aft along direction 515. A flange 517 extends from a rear of cuff 503 and includes an aperture 518. Linkage 504 includes a driver link 519 pivotally connected to aperture 518 by a pivot pin that extends through aperture 518. The linkage 504 further includes a toggle linkage 521 connected as described below.

Figure 61:
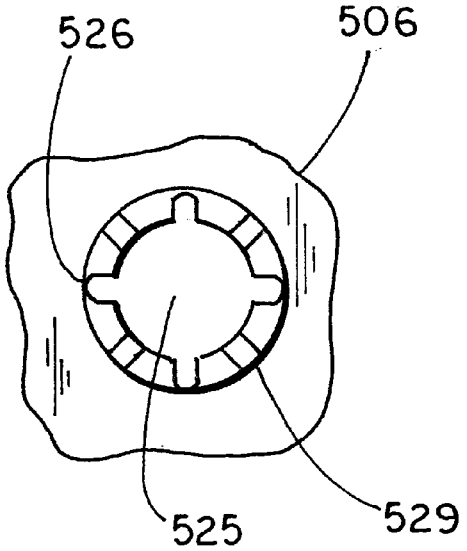

The braking mechanism 502 (FIG. 56) includes an extension frame 522 pivotally supported on the wheeled frame 501 by opposing configured pivot pins 523. The extension frame 522 includes parallel side flanges 524 that extend forwardly on both sides of a rear of the wheeled frame 501. The parallel side flanges 524 each have a hole that aligns with a configured hole 525 (FIG. 61) in the side frame flanges 506 of wheeled frame 501 near a front of the parallel side flanges 524. The configured holes 525 each have a central diameter portion that matches a shaft on the configured pivot pins 523, and further each have radially extending apertures 526 that match radially extending tabs 527 on the end of the configured pivot pins 523. Notably, there may exist two or more tabs 527 depending on the functional requirements of a particular design. The configured pivot pins 523 include a shaft 528 that fits mateably rotatably through the hole in the parallel side flanges 524 and into the aligned configured hole 525 in wheeled frame 501. By extending the configured pivot pin 523 to an inserted position, and then rotating the configured pivot pin 523 (e.g., about 45° to 100°, depending on the design), the configured pivot pin 523 is retained to the side frame flanges 506 of the wheeled frame 501. Optimally, there exist detents or bumps 529 on the hidden inside surface of the side frame flanges 506 that the tabs 527 frictionally slide over and engage as the configured pivot pin 523 is rotated into an interlocked position.

A braking member such as a braking wheel 530 (FIG. 56) is operably supported on the extension frame 522 for providing a controlled braking action by any of the several different ways described earlier in this application. The particular braking member 530 illustrated in FIG. 56 includes an internal hub 531 having components that frictionally engage and bind as the braking wheel 530 is pressed against the ground 532 with increasing force.

The linkage 504 (FIG. 56) includes a pair of short links 545 and 546 connected to the bottom end of driver link 519 at location 547 in a T-shaped or toggle-type arrangement. Specifically, the front short link 545 is pivoted to the shoe support plate 505 by a pin at location 548, and the rear short link 546 is pivoted to the extension frame 506 at location 550. When the skater is leaning forward or is in a normal skating position, the short links 545 and 546 are in a "broken" position, where they are not aligned. When the skater flexes his/her cuff 503 rearwardly, the driver link 519 moves the short links 545 and 546 to a more aligned position. The arrangement of the driver link 519 and the short links 545 and 546 provide an immediate mechanical advantage when the braking wheel 530 touches the ground surface. As the cuff 503 is moved further rearwardly, the short links 545 and 546 become more nearly aligned. As a person of ordinary skill will recognize, as the short links 545 and 546 become more nearly aligned, it takes even less force from the driver link 519 to move them farther. Thus, they produce a geometrically increasing mechanical advantage to the skater as the skater presses rearwardly with his/her cuff 503 to actuate the braking mechanism 502 and apply the brakes to stop. The mechanical advantage of the illustrated arrangement is so great that a skater can literally lift themselves off of the skating surface, with his/her weight being supported only by the braking wheel 530 and the front wheel 507. But of course, it is specifically contemplated that the linkage arrangement can be modified by making some or all links longer, shorter, pivoted in different locations, and even dynamically different through use of resilient links, and still be within the scope of the present invention.

In operation, the skater moves a braking element, such as a braking wheel, between a ground-engaging position and a ground-clearing position by flexing his/her cuff. The movement of the cuff causes the driver link to angularly move the extension frame relative to the wheeled frame with increasing mechanical advantage against the ground. A linear/angular movement of the cuff causes the brake wheel to provide a geometrically increasing braking force due to the mechanical advantage of the links 545 and 546.

Figure 57:
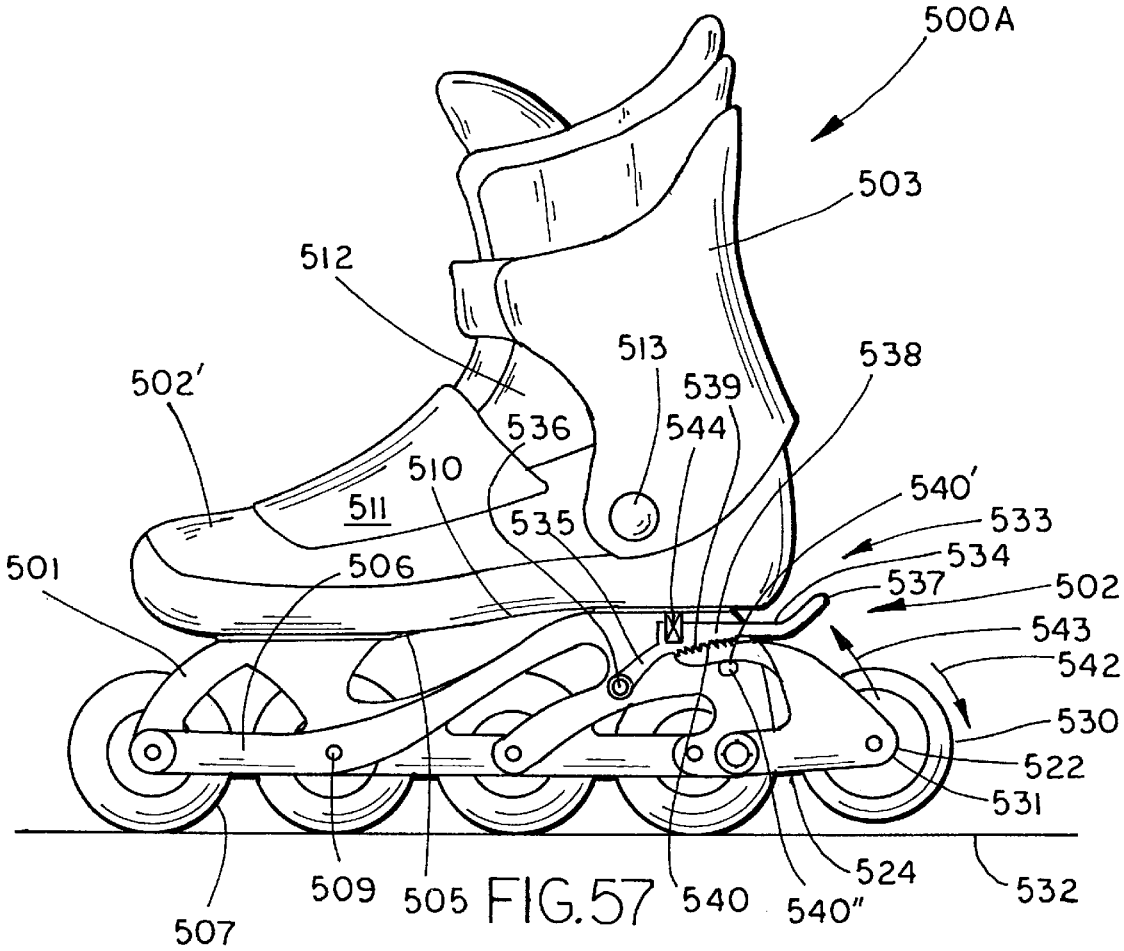
FIG. 57 is a side view of another roller skate embodying the present invention, the roller skate including an angular adjustment mechanism connecting the frame extension to the shoe main frame.

Another in-line roller skate 500A is shown in FIG. 57. In roller skate 500A, components and features that are similar or identical to the components of skate 500 are identified with identical numbers to reduce redundant discussion.

An adjuster 533 (FIG. 57) secures the extension frame 522 to the wheeled frame 501 at a predetermined (adjustable) angular position relative to the wheeled frame 501 with the braking wheel 530 located adjustably above a floor surface 532. The adjuster 533 is spaced above the configured pivot pin 523. The adjuster 533 includes a lever 534 having a front end 535 pivoted to the wheeled frame 501 at location 536, and a rear end 537 forming a handle that can be readily grasped by a skater or pressed on by the skater's other foot. In adjuster 533, extension frame 522 includes a serrated member 540' having teeth 540, which serrated member 540' is pivotally supported by a pin 540". The center section 538 includes a series of teeth 539 shaped to frictionally engage mating teeth 540 on the extension frame 522. It is contemplated that the mating teeth 539 and 540 can engage in a positive manner preventing any movement unless the lever 534 is moved upwardly to a disengaged position. Nonetheless, the teeth 539 and 540 as shown are oriented at an angle, so that the engaged teeth allow angular adjustment of the extension frame 522 in direction 542 without manually lifting the lever 534, but that allow angular adjustment of the extension frame 522 in direction 543 only if the lever 534 is lifted. The illustrated alternative allows a skater to downwardly adjust the position of the braking wheel 530 by simply pressing downwardly on the extension frame 530. However, upward adjustment cannot be done without manually lifting the lever 534, and then lifting the extension frame 522. A spring 544, such as a coil spring, leaf spring, or rubber piece, is located between the shoe support plate 505 and the lever 534. The spring 544 biases the lever 534 to a normally engaged position.

The adjuster can be manually manipulated to move the braking wheel closer to the ground while the brake mechanism is in the non-actuated rest position, thus changing a normal clearance of the braking member to a ground surface, so that the braking member engages the ground surface more or less quickly due to the change in the relative position. Advantageously, this adjustment can be done while wearing the skates.

It is specifically contemplated that the cuff link 519 and toggle mechanism of links 545 and 546, and also the adjuster 533 can be used with a sliding block as well as with a braking wheel, and still be within the scope of the present invention. Further, the adjuster feature of skate 500A can be incorporated into skate 500 by incorporating the lever 534 with teeth 539 and serrated member 540' with teeth 540 into link 546 (or 519), thus making link 546 (or 519) extendable. Alternatively, driver link 519, 546, or even 545 can be made manually extendable in a manner similar to that shown in FIGS. 53 and 54 to provide a brake-height-adjustment feature.

Figure 62:
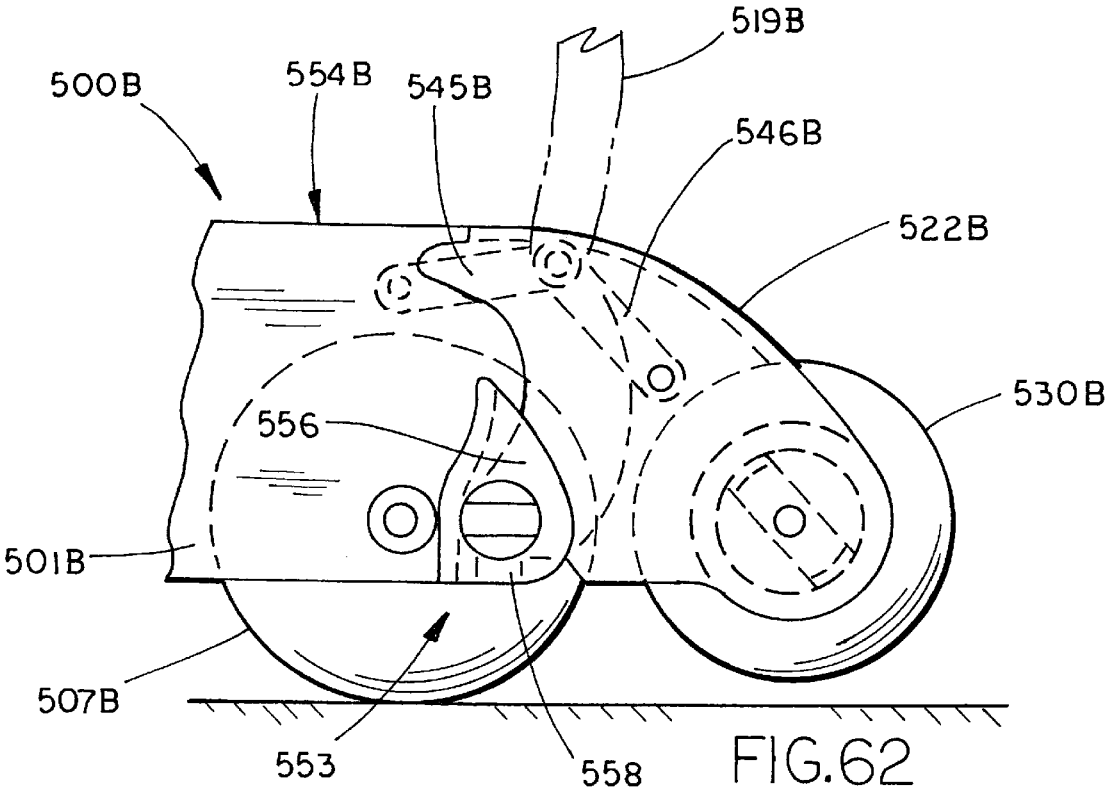
FIGS. 62 and 63 are side views of a quick-attach version of the roller skate and braking system shown in FIG. 56, FIG. 62 showing an un-braked condition and FIG. 63 showing a braked condition.
Figure 63:
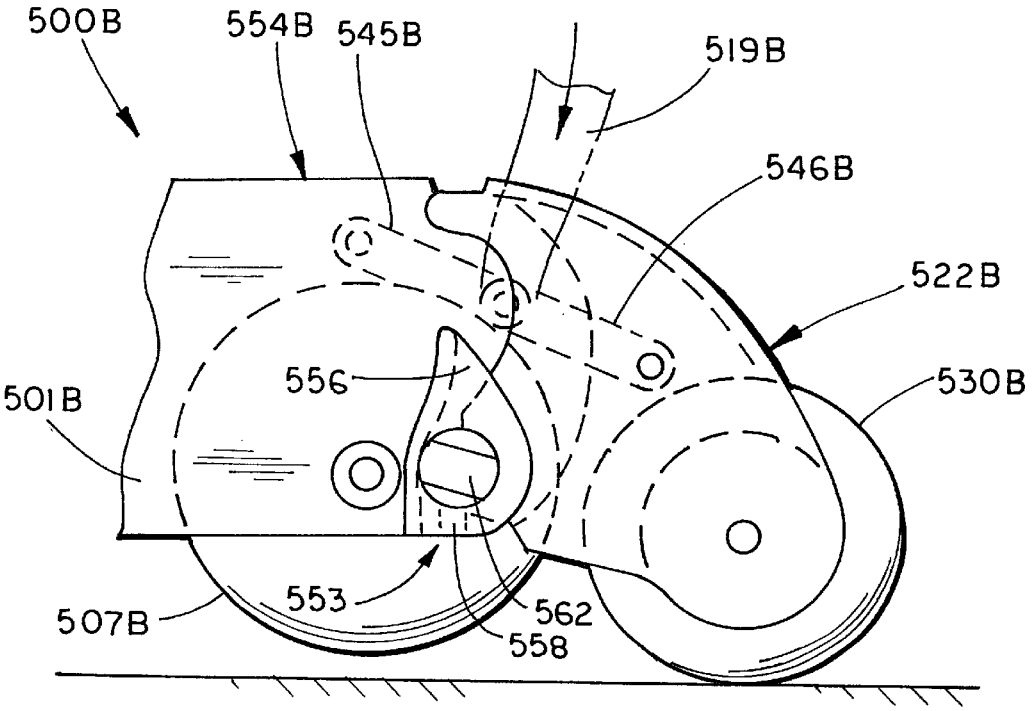

An in-line roller skate 500B (FIG. 62) similar to roller skate 500 (FIG. 56) includes a fastenerless quick-attach connection 553 that replaces pins 523 and configured holes 525. The features and components of roller skate 500B that are similar or identical to roller skate 500 are identified with identical numbers, but with addition of the letter "B" to reduce redundant discussion. Like roller skate 500, roller skate 500B is constructed to move its extension frame 522B between a raised non-braking position (FIG. 62) to a lowered braking position (FIG. 63).

Figure 65:
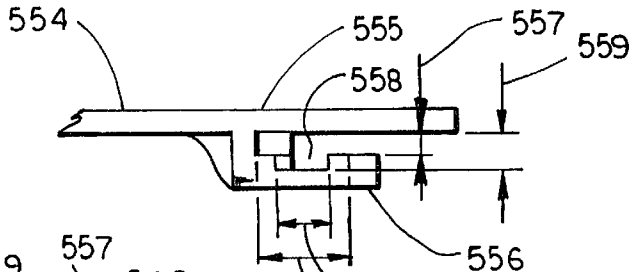
FIGS. 65 and 66 are fragmentary views taken along line LXV and LXVI in FIG. 64.
Figure 66:
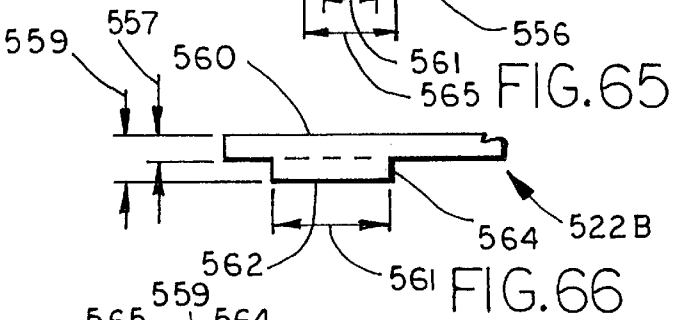
Figure 67:
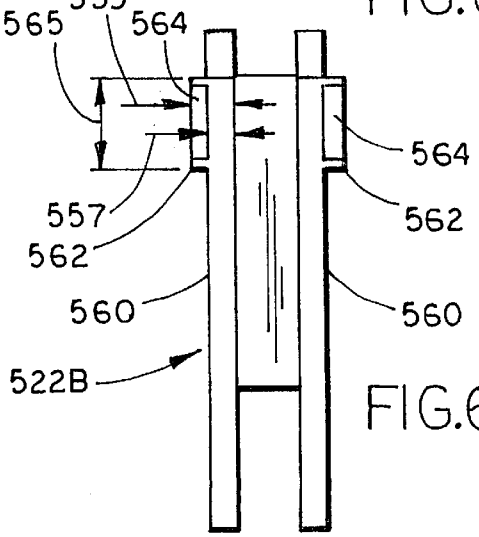
FIG. 67 is a front view of the extension frame taken in direction LXVII in FIG. 64.
Figure 64:
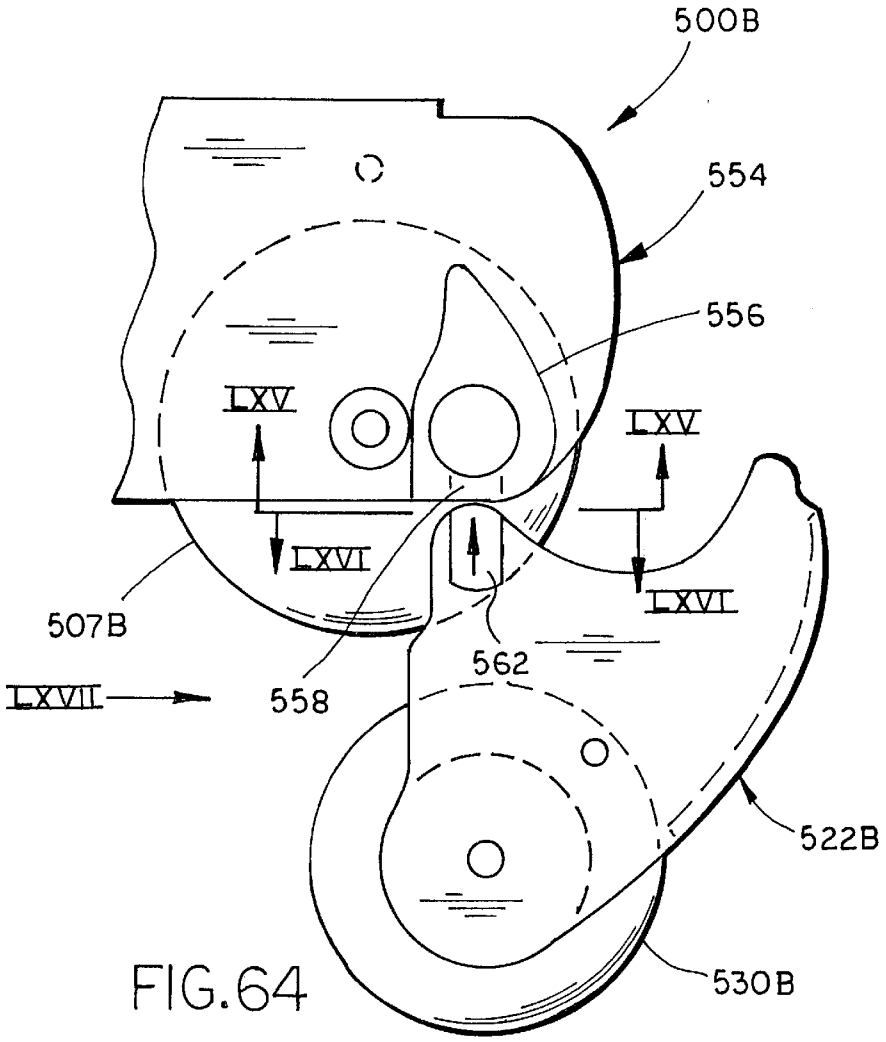
FIG. 64 is a side view showing assembly of the brake system to the roller skate of FIG. 62.

However, the extension frame 522B is further movable to an installation position before short links 545B and 546B are attached (see FIG. 64). Specifically, the rear end section 554 (FIG. 65) of each side of the wheeled frame 506B includes an inside member 555 and an outside member 556 defining a space with a dimension 559 therebetween. The outside member 556 (and/or the inside member 555) includes a vertical slot 558 defining an increased dimension 559. The extension frame 522B includes side flanges 560 having a thickness 557 and a protrusion 562 defining the increased dimension 559. The protrusion 562 is cylindrically shaped and has a diameter 565, except it has flat sides 564 spaced apart a distance 561 and has a thickness of dimension 559 so that, when properly aligned, the extension frame 552B can be moved vertically to slide the protrusions 562 into the slots 558. When rotated from the installed position (FIG. 64) to the use positions (see FIGS. 62 and 63), the flat sides 564 are misaligned, such that the extension frame 552B is secured to the wheeled frame 506B. Thereafter, the links 545 and 546 are connected to make the braking system operable.

Figure 69:
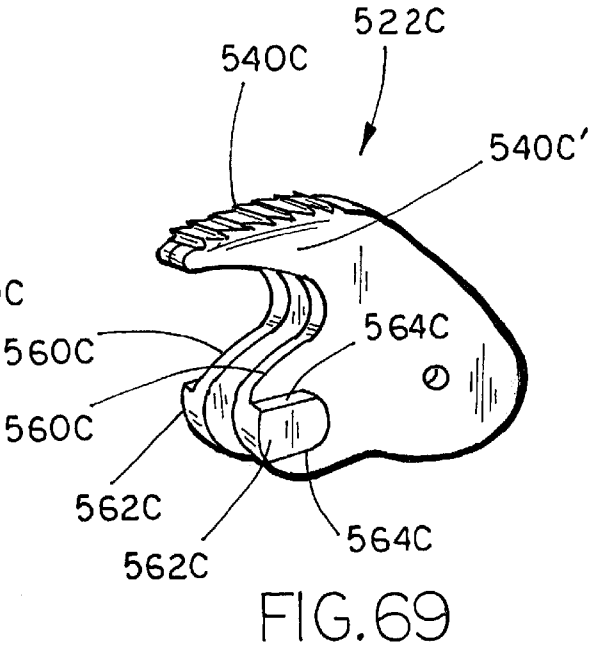
FIG. 69 is a perspective view of the extension frame shown in FIG. 68.
Figure 68:
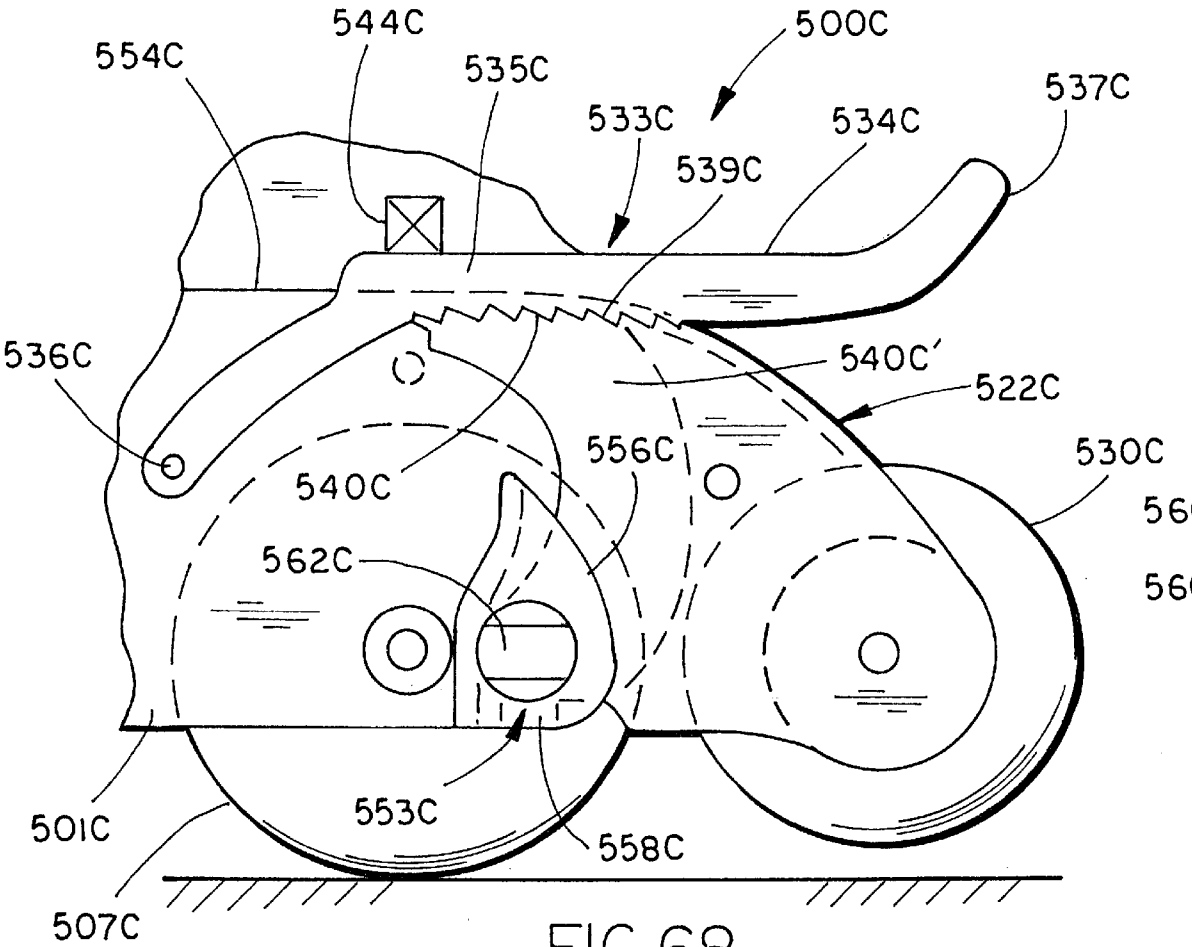
FIG. 68 is a side view of a roller skate and brake system incorporating the quick-attach aspect shown in FIG. 64 and the saw-tooth adjustment aspect shown in FIG. 57.

An in-line roller skate 500C (FIG. 68) is similar to roller skate 500A (FIG. 57) but includes the fastenerless quick-attach connection 553C of roller skate 500B (FIG. 64). In roller skate 500C, similar and identical features and components are identified with the same numbers, but with the addition of the letter "C." The construction and operation of roller skate 500C is believed to be clear to one of ordinary skill in this art such that further explanation is not necessary. Nonetheless, a perspective view of the extension frame 522C is shown in FIG. 69 for reference.

While the preferred embodiments of the present invention have been described, it should be understood that various changes, adaptations, combinations, and modifications may be made therein without departing from the spirit of the invention and the scope of the appended claims.

What is claimed is:

1. A roller skate comprising:

a wheeled frame including a pair of laterally spaced frame members with a plurality of aligned wheels mounted therebetween;

a shoe supported on the wheeled frame and including a cuff pivotally mounted relative to the wheeled frame;

a braking mechanism including an extension frame having a pair of laterally spaced flange members pivotally connected to respective rearward end portions of the pair of spaced frame members by quick-attach connections, a braking member operably supported between the pair of flange members, and an actuator assembly operably connected to the extension frame for pivoting the extension frame to generate a braking force upon contact of the braking member with a ground surface, the quick-attach connections including laterally extending protrusions formed on outer surfaces of the pair of flange members which releasably mate with end sections of the pair of frame members, each end section including an outer member having a forward edge attached to an outer surface of a respective frame member, each outer member having an inner surface spaced a predetermined distance from the outer surface of each frame member, the inner surface of each outer member having a vertical groove formed therein with the groove extending from a bottom end of the outer member upwardly to a circular recess also formed in the inner surface, and each protrusion being formed by a pair of flat side edges and a pair of arcuate end edges, the extension frame being attachable to the wheeled frame by sliding the protrusions into respective grooves in the outer members until the protrusions are received within the circular recesses and pivoting the protrusions within the circular recesses; and an adjuster lever pivotally mounted to the wheeled frame, the adjuster lever having a plurality of protrusions which interlock with a plurality of protrusions on the extension frame for providing a plurality of locked positions of height adjustment of the braking member above the ground surface by locking the extension frame in a plurality of selected positions of angular adjustment relative to the wheeled frame.

2. A roller skate comprising:

a wheeled frame including a pair of laterally spaced frame members with a plurality of aligned wheels mounted therebetween;

a shoe supported on the wheeled frame and including a cuff pivotally mounted relative to the wheeled frame;

a braking mechanism including an extension frame having a pair of laterally spaced flange members pivotally connected to respective rearward end portions of the pair of spaced frame members by quick-attach connections, a braking member operably supported between the pair of flange members, and an actuator assembly operably connected to the extension frame for pivoting the extension frame to generate a braking force upon contact of the braking member with a ground surface, the quick-attach connections including laterally extending protrusions formed on outer surfaces of the pair of flange members which releasably mate with end sections of the pair of frame members, each end section including an outer member having a forward edge attached to an outer surface of a respective frame member, each outer member having an inner surface spaced a predetermined distance from an outer surface portion of each frame member, each outer surface portion having a vertical groove formed therein with the groove extending from a bottom end of the frame member upwardly to a circular recess also formed in the outer surface portion, and each protrusion being formed by a pair of flat side edges and a pair of arcuate end edges, the extension frame being attachable to the wheeled frame by sliding the protrusions into respective grooves in the outer surface portions until the protrusions are received within the circular recesses and pivoting the protrusions within the circular recesses; and an adjuster lever pivotally mounted to the wheeled frame, the adjuster lever having a plurality of protrusions which interlock with a plurality of protrusions on the extension frame for providing a plurality of locked positions of height adjustment of the braking member above the ground surface by locking the extension frame in a plurality of selected positions of angular adjustment relative to the wheeled frame.

3. A roller skate comprising:

a wheeled frame including aligned wheels;

a shoe supported on the wheeled frame; and a braking mechanism including an extension frame pivotally supported on the wheeled frame, and further including a braking member supported on the extension frame in a ground-clearing position for selective engagement with a ground surface, and still further including an adjuster device, the adjuster device including an adjuster lever pivotally mounted to the wheeled frame and having a plurality of protrusions which interlock with a plurality of protrusions on the extension frame for providing a plurality of locked positions of height adjustments of the braking member above the ground surface by locking the extension frame in a plurality of selected positions of angular adjustment relative to the wheeled frame, the protrusions on the extension frame and the protrusions on the adjuster lever being configured to adjustably slip when the extension frame, is pivoted in a first direction of rotation towards the ground surface during selection of a locked position of height adjustment of the braking member above the ground surface, and being configured for locking the extension frame against pivotal movement in an opposite direction of rotation during engagement of the braking member with the ground surface thereby maintaining the selected locked position of height adjustment, the adjuster lever being pivotable to a release position for permitting pivotal movement of the extension frame in the opposite direction of rotation.

4. The roller skate defined in claim 3, wherein the extension frame and the wheeled frame include mating connectors forming a quick-attach connection.

5. The roller skate defined in claim 4, wherein the mating connectors are integrated into the extension frame and the wheeled frame, and characteristically do not include separate fasteners.

6. The roller skate defined in claim 5, wherein the mating connectors include a laterally-extending flat-sided protrusions formed on one of the extension frame and wheeled frame, and further include laterally extending slots shaped to slidingly receive the flat-sided protrusions only when flats on the flat-sided protrusions are aligned with the slots.

7. The roller skate defined in claim 3, wherein the plurality of protrusions on the adjuster lever and the plurality of protrusions on the extension frame include inter-engaging teeth.

8. The roller skate defined in claim 7, wherein the inter-engaging teeth include angled surfaces for slipping in a first direction and interlockingly engaging in a second direction.

9. The roller skate defined in claim 8, wherein the adjuster lever includes a portion forming a handle.

10. The roller skate defined in claim 9, wherein the adjuster device includes a spring biasing the adjuster lever into engagement with the extension frame.

11. The roller skate defined in claim 10, wherein the braking member includes a braking wheel.

12. The roller skate defined in claim 3, wherein the braking member includes a braking wheel.

13. The roller skate defined in claim 12, wherein the braking wheel includes an internal hub configured to generate friction that resists rotation when the braking wheel is engaged with the ground surface.

14. The roller skate as defined in claim 3, wherein the wheeled frame has a rear end with a first connector thereon; and the braking mechanism includes an extension frame supported on the wheeled frame, the extension frame including a second connector configured to releasably engage the first connector when angularly oriented in an installation position and configured to securely non-releasably engage the first connector when rotated to a use position where the second connector is securely retained by the first connector.

15. The roller skate defined in claim 14 wherein the first connector defines a throat and the second connector includes a protrusion shaped to slide through the throat when in the installation position, but shaped to not fit through the throat when in the use position.

16. The roller skate defined in claim 15 wherein the protrusion includes arcuate surfaces defining a cylindrical shape and further includes flat surfaces, the flat surfaces defining a first dimension permitting the protrusion to slide through the throat when in the installation position but the arcuate surfaces defining a second dimension larger than the first dimension preventing the protrusion from sliding through the throat when in the use position.

17. The roller skate defined in claim 14, including a quick-attach connection formed by a first connector on the wheeled frame and a second connector on the extension frame, the quick-attach connection being characterized by an absence of loose fasteners separate from the wheeled frame and the extension frame.

18. The roller skate defined in claim 17, wherein the first and second connectors form a quick-attach connection characterized by an absence of loose fasteners separate from the wheeled frame and the extension frame.

19. The roller skate defined in claim 18, wherein the second connector is formed integrally from material of the extension frame.

20. The roller skate defined in claim 19, wherein the first connector is formed integrally from material of the wheeled frame.

21. The roller skate defined in claim 20, wherein the first connector includes a pair of laterally spaced frame members, and wherein the second connector includes a pair of laterally spaced flange members pivotally connected to respective rearward end portions of the pair of spaced frame members.

22. The roller skate defined in claim 14, wherein the roller skate includes a cuff, and including a linkage connecting the cuff to the braking mechanism.

* * * * *